US006980190B2

(12) United States Patent
Ueda

(10) Patent No.: US 6,980,190 B2
(45) Date of Patent: Dec. 27, 2005

(54) LIQUID CRYSTAL DISPLAY DEVICE HAVING AN IMPROVED PRECHARGE CIRCUIT AND METHOD OF DRIVING SAME

(75) Inventor: Shiro Ueda, Chiba (JP)

(73) Assignee: Hitachi, Ltd., Tokyo (JP)

( * ) Notice: Subject to any disclaimer, the term of this patent is extended or adjusted under 35 U.S.C. 154(b) by 305 days.

(21) Appl. No.: 10/338,203

(22) Filed: Jan. 7, 2003

(65) Prior Publication Data

US 2003/0132903 A1 Jul. 17, 2003

(30) Foreign Application Priority Data

Jan. 16, 2002 (JP) ..... 2002-007336

(51) Int. Cl.[7] ..... G09G 3/36
(52) U.S. Cl. ..... 345/96; 345/98; 345/100
(58) Field of Search ..... 345/87, 89, 90, 345/92, 93, 94, 95, 96, 98, 99, 100, 88, 91, 345/97

(56) References Cited

U.S. PATENT DOCUMENTS 5,604,511 A * 2/1997 Ohi ..... 345/98
6,307,532 B1 * 10/2001 Aoki ..... 345/94
6,342,876 B1 * 1/2002 Kim ..... 345/87
6,492,970 B1 * 12/2002 Furuhashi et al. ..... 345/94
6,549,187 B1 * 4/2003 Matsubara et al. ..... 345/96
6,628,253 B1 * 9/2003 Hiroki ..... 345/87
6,842,161 B2 * 1/2005 Song et al. ..... 345/87
2004/0150612 A1 * 8/2004 Okuzono et al. ..... 345/100

* cited by examiner

*Primary Examiner*—Xiao Wu
*Assistant Examiner*—Jean Lesperance
(74) *Attorney, Agent, or Firm*—Milbank, Tweed, Hadley & McCloy LLP

(57) ABSTRACT

A liquid crystal display device includes a driver circuit for outputting a charging voltage at a beginning of a horizontal scanning period and then a gray scale voltage corresponding to a display data to a video signal line. The liquid crystal display device is driven by inverting a polarity of the gray scale voltage on a pixel electrode with respect to a common voltage on a common electrode every N lines of scanning lines, where N≧2 and by making a first charging time of the charging voltage corresponding to a first line of N lines of the scanning lines scanned immediately after inversion of the polarity of the gray scale voltage different from a second charging time of the charging voltage corresponding to a second line of the N lines scanned immediately succeeding the first line.

31 Claims, 15 Drawing Sheets

LIQUID CRYSTAL DISPLAY DEVICE HAVING AN IMPROVED PRECHARGE CIRCUIT AND METHOD OF DRIVING SAME

BACKGROUND OF THE INVENTION

The present invention relates to a liquid crystal display device and a method of driving the liquid crystal display device and, in particular, to a technology suitable for a driving method such as an N-line-inversion driving method in which the polarity of a gray scale voltage applied to a pixel is inverted every N scanning lines.

An active matrix type display device in which an active element (e.g., a thin film transistor) is provided to each pixel and is switched on and off is widely used as a display device for notebook personal computers (hereinafter referred to simply as personal computers), etc.

Among the active matrix type liquid crystal display devices, well known is a TFT type liquid crystal module comprising a liquid crystal display panel using thin film transistors (TFT) as its active elements, drain drivers disposed at the long side of the liquid crystal panel, gate drivers disposed at the short side of the liquid crystal panel, and an interface section disposed on the back of the liquid crystal display panel.

One of these liquid crystal display modules is known in which a precharge voltage is applied to drain signal lines in a liquid crystal display panel to charge the drain signal lines up to the precharge voltage during a pre-determined period at the beginning of one horizontal scanning period (hereinafter referred to as a precharge period).

Such a technique is described, for example, in Japanese Patent Laid-Open No. Hei 11-85107 (laid open on Mar. 30, 1999).

SUMMARY OF THE INVENTION

In general, if the same voltage (DC voltage) is applied across a liquid crystal layer for a long time, the tilt angle of liquid crystal molecules is fixed and as a result, the liquid crystal layer presents a phenomenon of image retention, and consequently, lifetime of the liquid crystal layer is shortened.

In order to prevent occurrence of this phenomenon, in a liquid crystal display module, the polarity of a voltage applied across a liquid crystal layer is inverted at intervals of a fixed length of time. A gray scale voltage applied to a pixel electrode is alternated between positive and negative polarities with respect to a common-electrode voltage applied on a common electrode at intervals of a fixed length of time.

Two driving methods are known which apply ac voltages across a liquid crystal layer, one is a symmetrical-about-fixed-common-electrode-voltage driving method, and the other is a common-electrode-voltage-inverting driving method.

The common-electrode-voltage-inverting driving method makes one of the common voltage on the common electrode and the gray scale voltage on the pixel electrode positive in polarity when the other is negative in polarity and vice versa.

The symmetrical-about-fixed-common-electrode-voltage-driving method keeps the common voltage applied on the common electrode fixed and alternates the gray scale voltage applied on the pixel electrode between positive and negative polarities with respect to the common-electrode voltage applied on the common electrode. Among examples of this driving method, known are a dot-inversion driving method and an n-line (e.g., two-line) inversion driving method.

In this specification, polarities of gray scale voltages applied on pixel electrodes are defined with respect to a voltage applied on a common electrode associated with the pixel electrodes in common.

FIGS. 16A and 16B are diagrams for assistance in explaining the polarities of gray scale voltages (that is, gray scale voltages applied to pixel electrodes) supplied to drain signal lines from a drain driver, in a case where the dot-inversion driving method is adopted as a method of driving a liquid display module.

In the dot-inversion driving method, as shown in FIG. 16A, in an odd-numbered frame, for example, the odd-numbered drain signal lines in odd-numbered scanning lines are supplied with a negative-polarity gray scale voltage (shown by solid circles in FIG. 16A) with respect to the common voltage (Vcom) applied on the common electrode from the drain driver, and the even-numbered drain signal lines in the odd-numbered scanning lines are supplied with a positive-polarity gray scale voltage (shown by open circles in FIG. 16A) with respect to the common voltage (Vcom) applied on the common electrode from the drain driver. On the other hand, the odd-numbered drain signal lines in even-numbered scanning lines are supplied with the positive-polarity gray scale voltage from the drain driver, and the even-numbered drain signal lines in the even-numbered scanning lines are supplied with the negative-polarity gray scale voltage from the drain driver.

The polarities of the voltages on each of the scanning lines is inverted on successive frames. As shown in FIG. 16B, in an even-numbered frame, the odd-numbered drain signal lines in the odd-numbered scanning lines are supplied with the positive-polarity gray scale voltage (shown by open circles in FIG. 16B) from the drain driver, and the even-numbered drain signal lines in the odd-numbered scanning lines are supplied with the negative-polarity gray scale voltage (shown by solid circles in FIG. 16B) from the drain driver. On the other hand, the odd-numbered drain signal lines in the even-numbered scanning lines are supplied with the negative-polarity gray scale voltage from the drain driver, and the even-numbered drain signal lines in the even-numbered scanning lines are supplied with the positive-polarity gray scale voltage from the drain driver.

With the dot-inversion driving method, the voltages of opposite polarities are applied to adjacent drain signal lines, and consequently, currents flowing through adjacent gate electrodes cancel each other, which makes it possible to reduce power consumption.

It is also possible to minimize deterioration of display quality since the current flowing into the common-electrode is small, hence the voltage drop due to the current is small, and the voltage on the common-electrode is stable.

However, in the case of a personal computer incorporating a liquid crystal display module employing the dot-inversion driving method, there has been a problem in that flicker occurs in a specific display pattern on a liquid crystal display panel and thereby display quality is degraded when there is a particular relationship between timing of polarity inversion and a displayed image pattern (for example, an ending pattern of Windows (a registered trade mark)).

This problem can be solved by adopting the N-line-inversion (for example, two-scanning-line inversion) driving method in which polarities of gray scale voltages supplied to drain signal lines from a drain driver are inverted every N scanning lines.

However, in a case where N-scanning-line-inversion (for example, two-scanning-line inversion) driving method is employed, there has been a problem in that spurious horizontal lines appear every N scanning lines as shown in FIG. 17, and consequently, the display quality on the liquid crystal display panel is severely degraded, for example, when a pattern of the same gray scale level and of the same color is displayed over the entire display area.

With the market demand for larger-sized liquid crystal panels in liquid crystal display devices such as liquid crystal display modules, the liquid crystal panels are required to increase their resolution capable of displaying XGA (Extended Graphics Array) display mode of 1024×768 pixels, SXGA (Super Extended Graphics Array) display mode of 1280×1024 pixels, and UXGA (Ultra Extended Graphics Array) display mode of 1600×1200 pixels.

Therefore, with increase in the number of horizontal scanning lines in one vertical scanning period, time available for writing per horizontal line is decreased, and consequently, a delay time (tDD) in output of the drain driver causes a serious problem.

Specifically, when the ratio of the delay time (tDD) in the output of the drain driver to the time available for writing per horizontal scanning line increases, pixel-writing voltage becomes insufficient, which causes remarkable deterioration in quality of the display on the liquid crystal display panel.

Therefore, a conventional liquid crystal display module is configured such that during a precharge period a precharge voltage is supplied to the drain signal lines to charge up the drain signal lines to the precharge voltage.

However, even if the precharge voltage is supplied to the drain signal line during the precharge period, the precharge voltage does not reach the required precharge voltage in the far-end portion of the drain signal lines far from the drain driver.

Thus, the write voltage becomes insufficient for the pixels disposed far from the drain driver, and it is thought that the display quality of images displayed on the liquid crystal display panel is greatly deteriorated.

The present invention has been made in order to solve the problems of the prior art, and an object of the present invention is to provide a technique for a liquid crystal display device and its driving method capable of preventing occurrence of spurious horizontal lines in a display area in the case where polarities of gray scale voltages are inverted every N ($N \geqq 2$) scanning lines and to enhance the display quality of displayed images.

Another object of the present invention is to provide a technique in a liquid crystal display device and its driving method capable of reducing voltage differences between voltages charged in the near-end portions of video signal lines proximate to a drain driver during the precharge period and voltages charged in the far-end portions of the video signal lines far from the drain driver during the precharge period, compared with the conventional techniques.

The above-mentioned objects and novel features of the present invention will be made clear by the following description and the accompanying drawings.

The representative structures of the present invention are as follows:

In accordance with an embodiment of the present invention, there is provided a method of driving a liquid crystal display device, said liquid crystal display device including a liquid crystal layer, a plurality of pixels arranged in a matrix configuration, each of said plurality of pixels being provided with a pixel electrode for generating an electric field in said liquid crystal layer between said pixel electrode and a common electrode associated with said plurality of pixels in common, a plurality of video signal lines coupled to said plurality of pixels, a plurality of scanning lines arranged to intersect said plurality of video signal lines and coupled to said plurality of pixels, and a driver circuit for outputting a charging voltage at a beginning of a horizontal scanning period and then a gray scale voltage corresponding to a display data to said plurality of video signal lines, said method comprising: inverting a polarity of said gray scale voltage with respect to a common voltage on said common electrode every N lines of said plurality of scanning lines, where $N \geqq 2$; and making a first charging time of said charging voltage corresponding to a first line of N lines of said plurality of scanning lines scanned immediately after inversion of said polarity of said gray scale voltage, different from a second charging time of said charging voltage corresponding to a second line of said N lines scanned immediately succeeding said first line.

In accordance with another embodiment of the present invention, there is provided a method of driving a liquid crystal display device, said liquid crystal display device including a liquid crystal layer, a plurality of pixels arranged in a matrix configuration, each of said plurality of pixels being provided with a pixel electrode for generating an electric field in said liquid crystal layer between said pixel electrode and a common electrode associated with said plurality of pixels in common, a plurality of video signal lines coupled to said plurality of pixels, a plurality of scanning lines arranged to intersect said plurality of video signal lines and coupled to said plurality of pixels, and a driver circuit for outputting a charging voltage at a beginning of a horizontal scanning period and then a gray scale voltage corresponding to a display data to said plurality of video signal lines, said method comprising varying a charging time of said charging voltage with a distance from said driver circuit to a scanned one of said plurality of scanning lines.

In accordance with another embodiment of the present invention, there is provided a method of driving a liquid crystal display device, said liquid crystal display device including a liquid crystal layer, a plurality of pixels arranged in a matrix configuration, each of said plurality of pixels being provided with a pixel electrode for generating an electric field in said liquid crystal layer between said pixel electrode and a common electrode associated with said plurality of pixels in common, a plurality of video signal lines coupled to said plurality of pixels, a plurality of scanning lines arranged to intersect said plurality of video signal lines and coupled to said plurality of pixels, a driver circuit for outputting a charging voltage at a beginning of a horizontal scanning period and then a gray scale voltage corresponding to a display data to said plurality of video signal lines, and a display control device for outputting an ac-driving signal for controlling ac-driving of said liquid crystal layer and for outputting a charge-control clock to said driver circuit, said method comprising: inverting a polarity of said gray scale voltage with respect to a common voltage on said common electrode every N lines of said plurality of scanning lines based upon said ac-driving signal, where $N \geqq 2$; and varying a duration of a first level of said charge-control clock with time such that a first charging time of said charging voltage corresponding to a first line of N lines of said plurality of scanning lines scanned immediately after inversion of said polarity of said gray scale voltage is different from a second charging time of said charging voltage corresponding to a second line of said N lines scanned immediately succeeding said first line.

In accordance with another embodiment of the present invention, there is provided a method of driving a liquid crystal display device, said liquid crystal display device including a liquid crystal layer, a plurality of pixels arranged in a matrix configuration, each of said plurality of pixels being provided with a pixel electrode for generating an electric field in said liquid crystal layer between said pixel electrode and a common electrode associated with said plurality of pixels in common, a plurality of video signal lines coupled to said plurality of pixels, a plurality of scanning lines arranged to intersect said plurality of video signal lines and coupled to said plurality of pixels, a driver circuit for outputting a charging voltage at a beginning of a horizontal scanning period and then a gray scale voltage corresponding to a display data to said plurality of video signal lines, and a display control device for outputting a charge-control clock to said driver circuit, said method comprising varying a duration of a first level of said charge-control clock with time such that a charging time of said charging voltage varies with a distance from said driver circuit to a scanned one of said plurality of scanning lines.

In accordance with another embodiment of the present invention, there is provided a liquid crystal display device comprising: a liquid crystal layer; a plurality of pixels arranged in a matrix configuration, each of said plurality of pixels being provided with a pixel electrode for generating an electric field in said liquid crystal layer between said pixel electrode and a common electrode associated with said plurality of pixels in common; a plurality of video signal lines coupled to said plurality of pixels; a plurality of scanning lines arranged to intersect said plurality of video signal lines and coupled to said plurality of pixels; a driver circuit for outputting a charging voltage at a beginning of a horizontal scanning period and then a gray scale voltage corresponding to a display data to said plurality of video signal lines; and a display control device for outputting an ac-driving signal for controlling ac-driving of said liquid crystal layer and for outputting a charge-control clock to said driver circuit, wherein said display control device is provided with a pulse-duration-varying circuit for varying a duration of a first level of said charge-control clock, and said driver circuit includes: a polarity-inverting circuit for inverting a polarity of said gray scale voltage with respect to a common voltage on said common electrode every N lines of said plurality of scanning lines based upon said ac-driving signal, where $N \geqq 2$, and a charging-time control circuit for controlling a charging time of said charging voltage based upon said duration of said first level of said charge-control clock such that a first charging time of said charging voltage corresponding to a first line of N lines of said plurality of scanning lines scanned immediately after inversion of said polarity of said gray scale voltage is different from a second charging time of said charging voltage corresponding to a second line of said N lines scanned immediately succeeding said first line.

In accordance with another embodiment of the present invention, there is provided a liquid crystal display device comprising: a liquid crystal layer; a plurality of pixels arranged in a matrix configuration, each of said plurality of pixels being provided with a pixel electrode for generating an electric field in said liquid crystal layer between said pixel electrode and a common electrode associated with said plurality of pixels in common; a plurality of video signal lines coupled to said plurality of pixels; a plurality of scanning lines arranged to intersect said plurality of video signal lines and coupled to said plurality of pixels; a driver circuit for outputting a charging voltage at a beginning of a horizontal scanning period and then a gray scale voltage corresponding to a display data to said plurality of video signal lines; and a display control device for outputting a charge-control clock, wherein said display control device is provided with a pulse-duration-varying circuit for varying a duration of a first level of said charge-control clock, and said driver circuit includes a charging-time control circuit for varying a charging time of said charging voltage based upon said duration of said first level of said charge-control clock such that said charging time of said charging voltage varies with a distance from said driver circuit to a scanned one of said plurality of scanning lines.

BRIEF DESCRIPTION OF THE DRAWINGS

In the accompanying drawings, in which like reference numerals designate similar components throughout the figures, and in which.

DETAILED DESCRIPTION OF THE PREFERRED EMBODIMENTS

Figure 1:
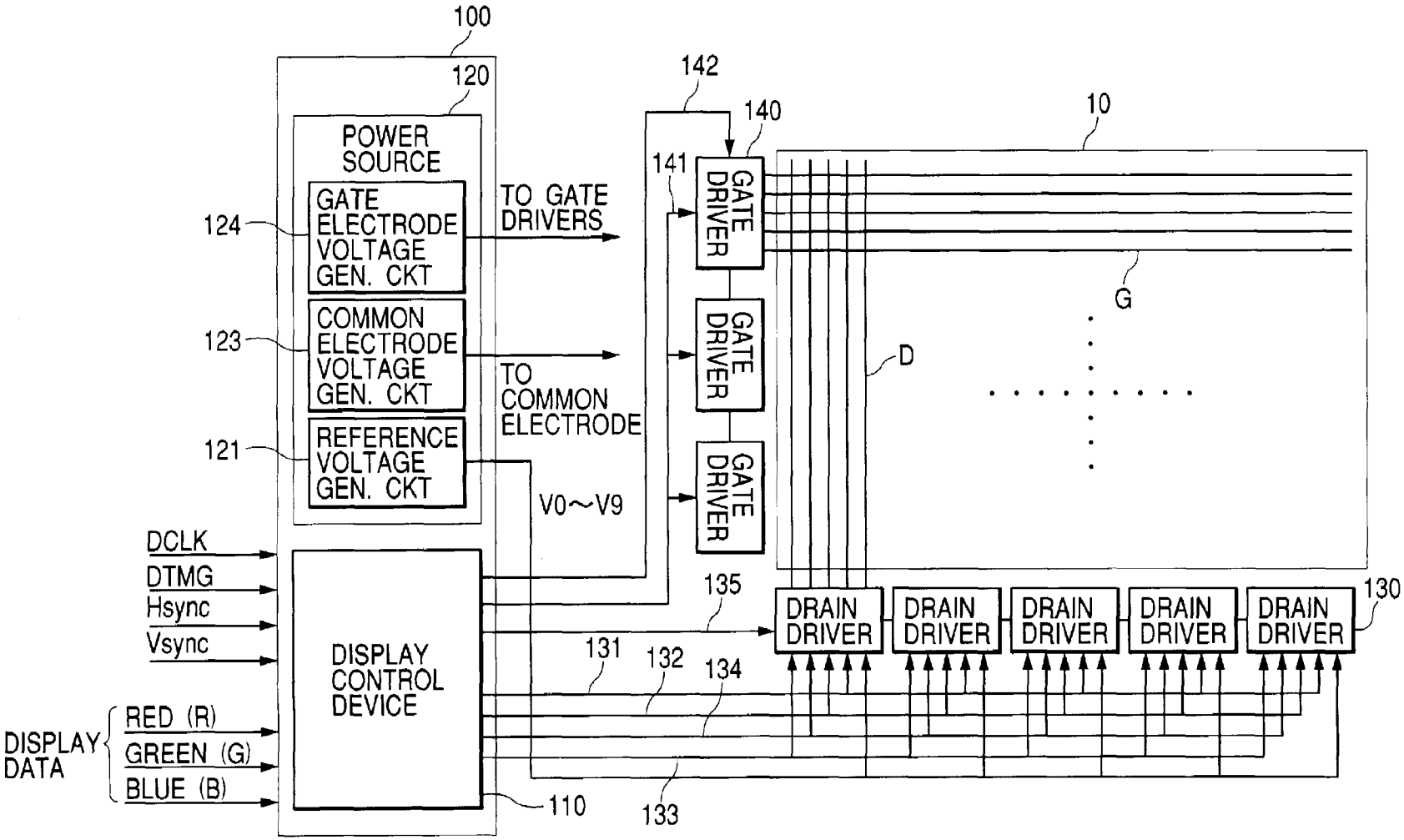
FIG. 1 is a block diagram showing a schematic configuration of a liquid crystal display module to which the present invention is applicable.

The preferred embodiments of the present invention will now be described in detail referring to the drawings.

In the figures referred to for the explanation of embodiments, the components having the same function are given like reference numerals and the repetition of the explanation will be omitted.

Basic Configuration of a TFT Type Liquid Crystal Display Module to which the Present Invention is Applicable FIG. 1 is a block diagram showing a schematic configuration of a liquid crystal display module to which the present invention is applicable.

In the liquid crystal module shown in FIG. 1, drain drivers 130 are disposed on a long side of a liquid crystal panel 10 and gate drivers 140 are disposed on a short side of the liquid crystal panel 10. The drain drivers 130 and the gate drivers 140 are directly mounted at the peripheral portion of one of glass substrates (for example, TFT-mounted substrate, hereinafter TFT substrate) of the liquid crystal display panel 10. An interface section 100 is mounted on an interface board, and this interface board is mounted on the rear surface of the liquid crystal display panel 10.

Configuration of the Liquid Crystal Display Panel 10 Shown in FIG. 1

Figure 2:
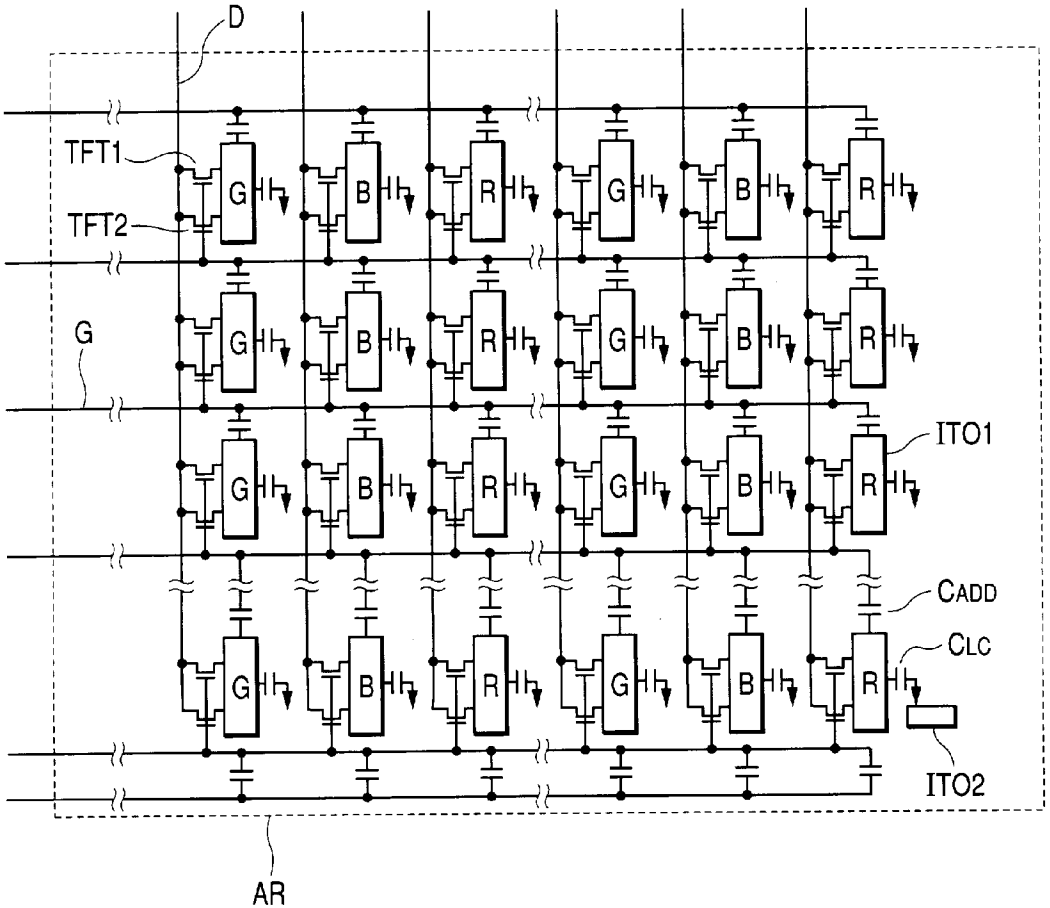
FIG. 2 shows an equivalent circuit of an example of the liquid crystal display panel shown in FIG. 1.

FIG. 2 shows an equivalent circuit of an example of the liquid crystal display panel 10 shown in FIG. 1. As shown in FIG. 2, the liquid crystal display panel 10 has a plurality of pixels arranged in a matrix configuration. Each pixel is disposed in an area surrounded by two adjacent drain signal lines (D) and two adjacent gate signal lines (G).

Each pixel has thin film transistors (TFT1, TFT2). Source electrodes of the thin film transistors (TFT1, TFT2) of each pixel are connected to a pixel electrode (ITO1). A liquid crystal layer is provided between the pixel electrode (ITO1) and a common electrode (ITO2), and therefore an equivalent liquid-crystal-formed capacitance (CLC) formed by the liquid crystal layer is illustrated as connected between the pixel electrode (ITO1) and the common electrode (ITO2). Further, a storage capacitance (CADD) is connected between the source electrodes of the thin film transistors (TFT1, TFT2) and an immediately-preceding gate signal line (G).

Figure 3:
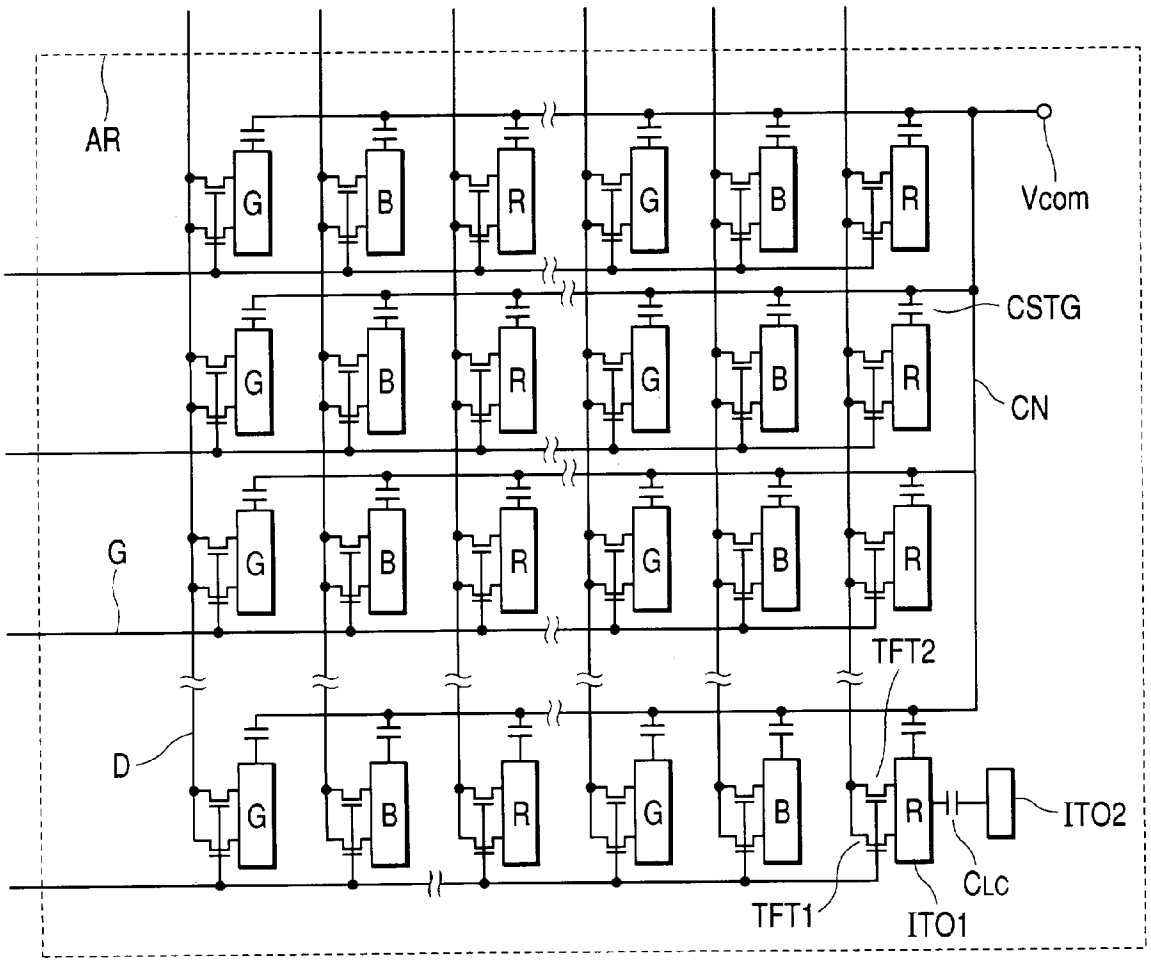
FIG. 3 shows an equivalent circuit of another example of the liquid crystal display panel shown in FIG. 1.

FIG. 3 shows an equivalent circuit of another example of the liquid crystal display panel 10 shown in FIG. 1.

In the example shown in FIG. 2, the storage capacitance (CADD) is formed between the gate signal line (G) for the immediately-preceding scanning line and the source electrodes, but in the equivalent circuit in the example shown in FIG. 3 additional capacitance (CSTG) is formed between the common signal line (COM) and the source electrodes.

The present invention is applicable to both the two liquid crystal display panels illustrated in FIGS. 2 and 3, respectively. In the liquid crystal panel 10 shown in FIG. 2, pulses applied on the immediately-preceding gate signal line (G) are introduced into the pixel electrodes (ITO1) through the storage capacitance (CADD), but in the liquid crystal panel 10 shown in FIG. 3, the introduction of the pulses into the pixel electrode does not occur, and therefore better display quality can be obtained.

FIGS. 2 and 3 show the equivalent circuits of the liquid crystal display panels of the vertical electric field type (the so-called Twisted Nematic type). In FIGS. 2 and 3, reference symbol AR denotes a display area. FIGS. 2 and 3 are circuit diagrams depicted to correspond to the actual geometrical arrangement.

In the liquid crystal display device of the vertical electric field type, the transmission of light at each pixel is controlled by a vertical electric field applied across a layer of a liquid crystal material sandwiched between a pair of opposing transparent electrodes formed on the inner surfaces of a pair of opposing transparent substrates. Each pixel is formed by two electrodes formed on the inner surfaces of the two opposing transparent substrates, respectively. For the purpose of device construction and operation, U.S. Pat. No. 3,918,796, issued to Fergason on Nov. 11, 1975, is hereby incorporated by reference.

In the liquid crystal display panel 10 shown in FIGS. 2 and 3, the drain electrodes of the thin film transistors (TFT1 TFT2) of all the pixels arranged along one column are connected to the same drain signal line (D). Each drain signal line (D) is connected to the drain driver 130 (see FIG. 1) which supplies gray scale voltages to the liquid crystal of the pixels arranged in the same column.

The gate electrodes of thin film transistors (TFT1 TFT2) of all the pixels arranged in the same row are connected to the same gate signal line (G), and each gate signal line (G) is connected to the gate driver 140 which supplies the scanning drive voltage (positive or negative bias voltage) to the gate electrodes of thin film transistors (TFT1 TFT2) of each of the pixels arranged in a corresponding one of the rows during one horizontal scanning period.

Configuration of the Interface Section 100 Shown in FIG. 1 and the Outline of its Operation The display control device 110 shown in FIG. 1 is formed of one large-scale integrated circuit (LSI) and controls and drives drain drivers 130 and gate drivers 140 based on display control signals such as an external clock signal (DCLK), a display timing signal (DTMG), a horizontal sync signal (Hsync) and a vertical sync signal (Vsync) and display data (red, green, blue signals), sent from a computer main body.

Upon receipt of the display timing signal (DTMG), the display control device 110 judges it as a display start position and outputs a start pulse (a display-data-take-in start signal) to the first drain driver 130 via a signal line 135, and then outputs received display data corresponding to one row of pixels to the drain drivers 130 via a display data bus 133. At this time the display control device 110 outputs display-data-latch clocks (CL2) (hereinafter referred to simply as clocks (CL2) which serves as display control signals for latching display data, to a data latch circuit (not shown) of each of the drain drivers 130 via a signal line 131.

The display data sent from the computer main body are transmitted in the form of trios of red (R), green (G) and blue (B) display data each comprising six bits per pixel, for example, during a specified time.

Latching operation of the data latch circuit in the first drain driver 130 is controlled by the start pulse input to the first drain driver 130. After completion of the latching operation of the data latch circuit in the first drain driver 130 is over, a start pulse is output from the first drain driver 130 to the second drain driver 130, and the latching operation of the data latch circuit in the second drain driver 130 is controlled by the start pulse. Continuing in a like manner, the latching operation of the data latch circuits in successive drain drivers 130 is controlled such that the display data are properly written into the data latch circuits.

At a time when inputting of the display timing signal (DTMG) has been completed, or at a specified time after the inputting of the display timing signal (DTMG), the display control device judges that inputting of display data corresponding to one horizontal scanning line has been completed, and then the display control device 110 supplies to the respective drain drivers 130 via signal lines 132, output-timing-control clocks (CL1) (hereinafter referred to simply as the clocks (CL1)) which serve as display control signals for outputting gray scale voltages corresponding to the display data stored in the data latch circuits of the drain drivers 130, to the drain signal lines (D) of the liquid crystal display panel 10.

When the display control device 110 is supplied with the first display timing signal (DTMG) after the input of a vertical sync signal (Vsnc), the display control device 110 judges the first display timing signal (DTMG) as a time for the first display line and then outputs a frame start command signal (FLM) to one of the gate drivers 140 through a signal line 142.

Based on the horizontal sync (Hsync), the display control device 110 outputs clocks (CL3) which serve as shift clocks having a repetition period equal to one horizontal scanning period, to the gate drivers 140 via a signal line 141 such that the gate drivers 140 apply positive bias voltages to respective ones of the gate signal lines (G) of the liquid crystal display panel 10 successively with a horizontal scanning period. With this, a plurality of thin film transistors (TFT1 TFT2) connected to each of the gate signal lines (G) of the liquid crystal display panel 10 are conducting during one horizontal scanning period. The operation mentioned in the above display images on the liquid crystal display panel 10.

Configuration of the Power Supply Circuit 120 shown in FIG. 1

A power supply circuit 120 shown in FIG. 1 includes a gray scale reference voltage generator circuit 121, a common-electrode (counter electrode) voltage generator circuit 123 and a gate-electrode voltage generator circuit 124. The gray scale reference voltage generator circuit 121 is formed of a series-resistance voltage divider circuit and outputs 10-level-gray-scale reference voltages (V0 to V9). These gray scale reference voltages (V0 to V9) are supplied to respective drain drivers 130. An ac driving signal (timing signal for ac driving, M) is also supplied to each of the drain drivers 130 from the display control device 110 via a signal line 134. The common-electrode voltage generator circuit 123 generates a common voltage (Vcom) to be applied to the common electrode (ITO2), the gate-electrode voltage generator circuit 124 generates drive voltages (positive and negative bias voltages) to be applied to the gate electrodes of thin film transistors (TFT1 TFT2).

Configuration of Drain Drivers 130 Shown in FIG. 1

Figure 4:
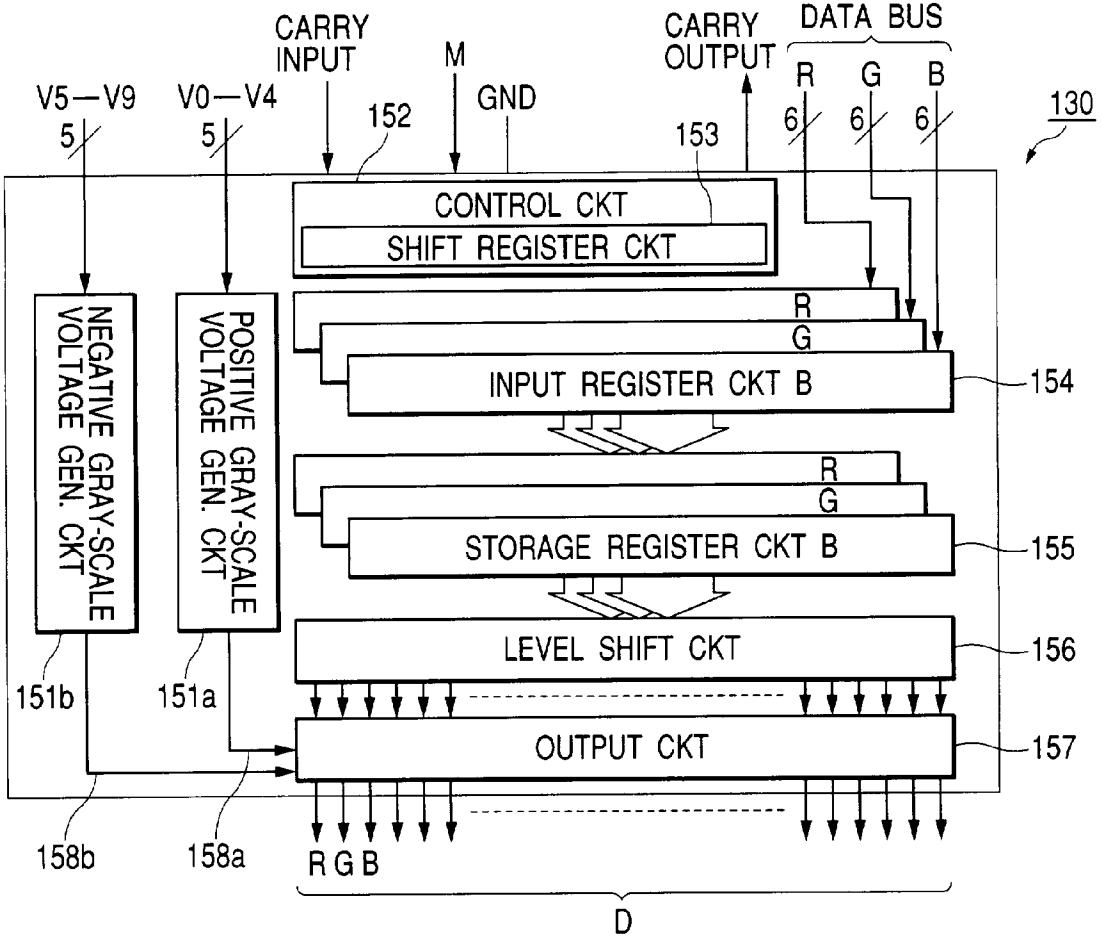
FIG. 4 is a block diagram showing an schematic configuration of an example of the drain driver shown in FIG. 1.

FIG. 4 is a block diagram showing a schematic configuration of an example of the drain drivers 130 shown in FIG. 1. Each of the drain drivers 130 is composed of one large-scale integrated circuit (LSI).

In FIG. 4, a positive-polarity gray-scale voltage generator circuit 151*a* generates positive-polarity 64-level-gray-scale voltages based on positive-polarity 5-level-gray-scale reference voltages (V0 to V4) supplied from the gray scale reference voltage generator circuit 121 (see FIG. 1.), and outputs the positive-polarity 64-level-gray-scale voltages to an output circuit 157 via a voltage bus 158*a*. A negative-polarity gray-scale voltage generator circuit 151*b* generates negative-polarity 64-level-gray-scale voltages based on negative-polarity 5-level-gray-scale reference voltages (V5 to V9) supplied-from the gray scale reference voltage generator circuit 121 and outputs the negative-polarity 64-level-gray-scale voltages to the output circuit 157 via a voltage bus 158*b*.

A shift register circuit 153 in a control circuit 152 of the drain driver 130 generates a data-take-in signal to be used in an input register circuit 154 based on a clock (CL2) supplied from the display control device 110 (see FIG. 1) and outputs the data-take-in signal to an input register circuit 154. The input register circuit 154 latches data each comprising six bits per color which are equal in number to the number of the output terminals of the drain drivers 130 in synchronism with the clock (CL2) input from the display control device 110 based on the data-take-in signal output from the shift register circuit 153.

Upon receipt of the clock (CL1) from the display control device 110, a storage register circuit 155 latches in the storage register circuit 155 the display data stored in the input register circuit 154. The display data taken in the storage register circuit 155 are input to the output circuit 157 via a level shift circuit 156.

The output circuit 157 selects gray scale voltages corresponding to display data from among the positive-polarity 64 gray scale voltages and negative-polarity 64 gray scale voltages, and outputs the selected gray scale voltages to corresponding ones of the drain signal lines (D).

Figure 5:
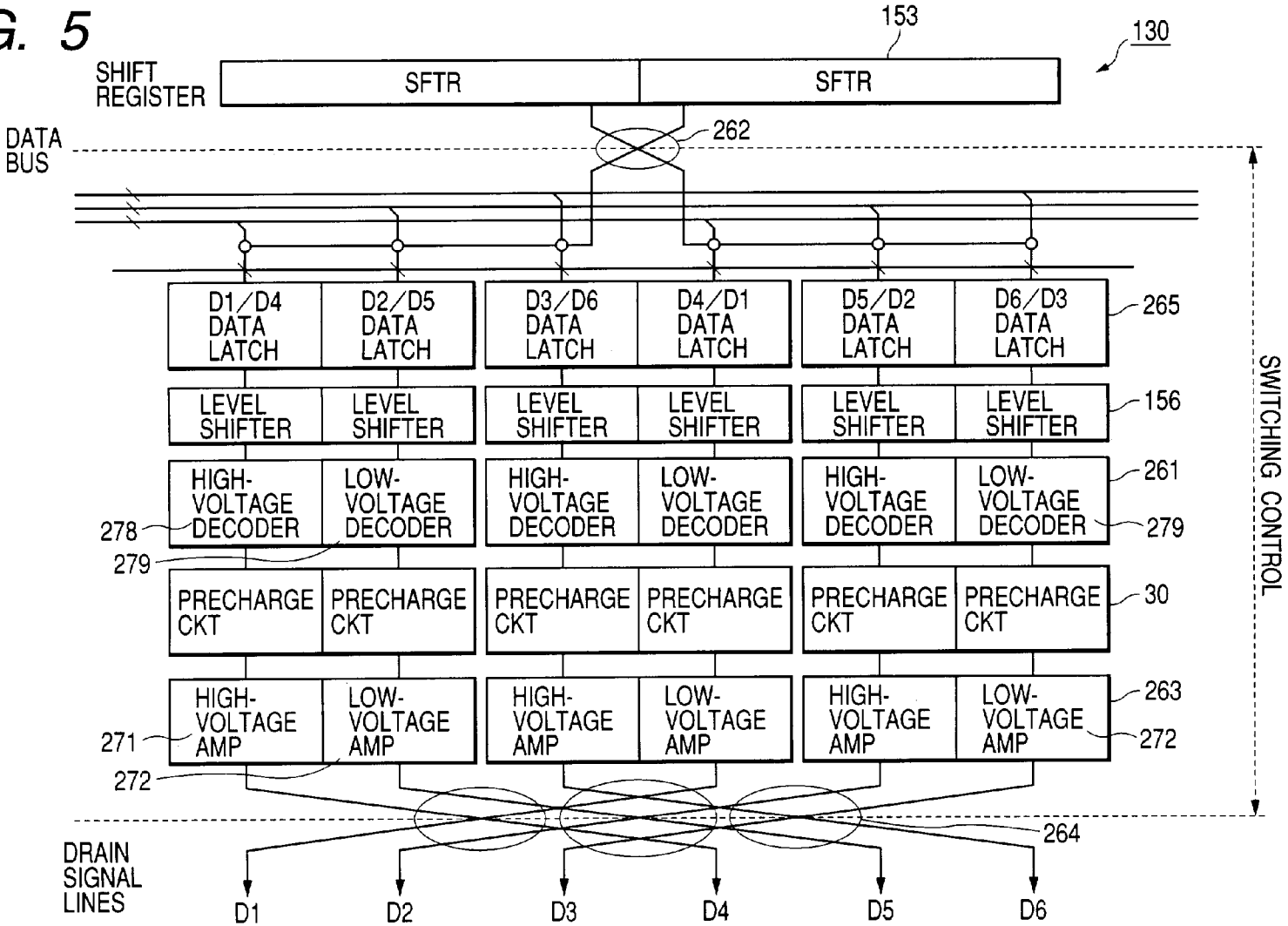
FIG. 5 is a block diagram for explaining the configuration of the drain driver shown in FIG. 5, centering on a constitution of its output circuit.

FIG. 5 is a block diagram for explaining the configuration of the drain driver 130 shown in FIG. 4, centering on the configuration of the output circuit 157.

In FIG. 5, reference numeral 153 denotes a shift register circuit in the control circuit 152 shown in FIG. 4, and reference numeral 156 denotes a level shift circuit shown in FIG. 4. A data latch circuit 265 represents the input register circuit 154 and the storage register circuit 155 shown in FIG. 4. Further, a decoder section (a gray-scale voltage selector circuit) 261, an amplifier-pair circuit 263, and a switch section (2) 264 for switching the outputs of the amplifier-pair circuit 263 constitute the output circuit 157 shown in FIG. 4.

A switch section (1) 262 and the switch section (2) 264 are controlled based on the ac-driving signal (M). Reference characters D1 to D6 denote the first to sixth drain signal lines (D), respectively.

In the drain driver 130 shown in FIG. 5, a data-take-in signal to be input into the data latch circuit 265 (to be more specific, the input register 154 shown in FIG. 4) is switched by the switch section (1) 262 and the data display for the same color is input to the adjacent data latch circuit 265 of the same color.

The following explains the decoder section 261 and the amplifier-pair circuit 263. A precharge control circuit (hereinafter referred to simply as the precharge circuit) 30 will be explained later.

The decoder section 261 includes a high-voltage decoder circuit 278 and a low-voltage decoder circuit 279. The high-voltage decoder circuit 278 selects positive-polarity gray-scale voltages corresponding to the display data supplied from respective data latch circuits 265 (to be more specific, the storage register 155 shown in FIG. 4) from among the positive-polarity 64-level-gray-scale voltages supplied from the gray-scale voltage generator circuit 151*a* via the voltage bus 158*a*. The low-voltage decoder circuit 279 selects negative-polarity gray-scale voltages corresponding to the display data supplied from respective data latch circuits 265 from among negative-polarity 64-level-gray-scale voltages output from the gray-scale voltage generator circuit 151*b* via the voltage bus 158*b*

A pair of the high-voltage decoder circuit 278 and the low-voltage decoder circuit 279 are provided to a pair of adjacent data latch circuits 265. The amplifier-pair circuit 263 is composed of a high-voltage amplifier circuit 271 and a low-voltage amplifier circuit 272. The high-voltage amplifier circuit 271 receives positive-polarity gray-scale voltages generated in the high-voltage decoder circuit 278, current-amplifies the positive-polarity gray-scale voltages, and then outputs them. The low-voltage amplifier circuit 272 receives the negative-polarity gray-scale voltages generated in the low-voltage decoder circuit 279, current-amplifies the negative-polarity gray-scale voltages, and then outputs them.

In the dot-inversion driving method, the polarities of the gray scale voltages applied to the two adjacent drain signal lines D1, D4, for example for displaying the same color, respectively, are opposite from each other. An arrangement of the high-voltage amplifier circuits 271 and the low-voltage amplifier circuits 272 of the amplifier-pair circuits 263 is in the order of the high-voltage amplifier circuit 271→the low-voltage amplifier circuit 272→the high-voltage amplifier circuit 271→the low-voltage amplifier circuit 272.

Initially, by switching data-take-in signals inputted to the data latch circuit 265 by the switch section (1) 262, one of two display data inputted to the adjacent drain signal lines D1, D4, for example, respectively, for displaying the same color, the data for the drain signal line D1, for example, is inputted to a D1/D4 data latch in FIG. 5 of the data latch circuit 265 connected to the high-voltage amplifier circuit 271, and the data for the other drain signal line D4 is inputted to a D4/D1 data latch in FIG. 5 of the data latch circuit 265 connected to the low-voltage amplifier circuit 272, and at this time the switch section (2) 264 is set such that an output from the high-voltage amplifier circuit 271 is supplied to the drain signal line D1 and an output from the low-voltage amplifier circuit 272 is supplied to the drain signal line D4.

Next, by switching the switch section (1) 262 such that the data for the drain signal line D1 is inputted to the D1/D4 data latch of the data latch circuit 265 connected to the low-voltage amplifier circuit 272, and the data for the drain signal line D4 is inputted to the D1/D4 data latch of the data latch circuit 265 connected to the high-voltage amplifier circuit 271, and at this time the switch section (2) 264 is set such that an output from the low-voltage amplifier circuit 272 is supplied to the drain signal line D1 and an output from the high-voltage amplifier circuit 271 is supplied to the drain signal line D4.

With the above configuration, the first drain signal line D1 and the fourth drain signal D4 are supplied with gray scale voltages of opposite polarities, respectively, and the polarities of the gray scale voltages supplied to the first and fourth drain signal lines are inverted periodically.

Operation of a Precharge Circuit 30

Figure 6:
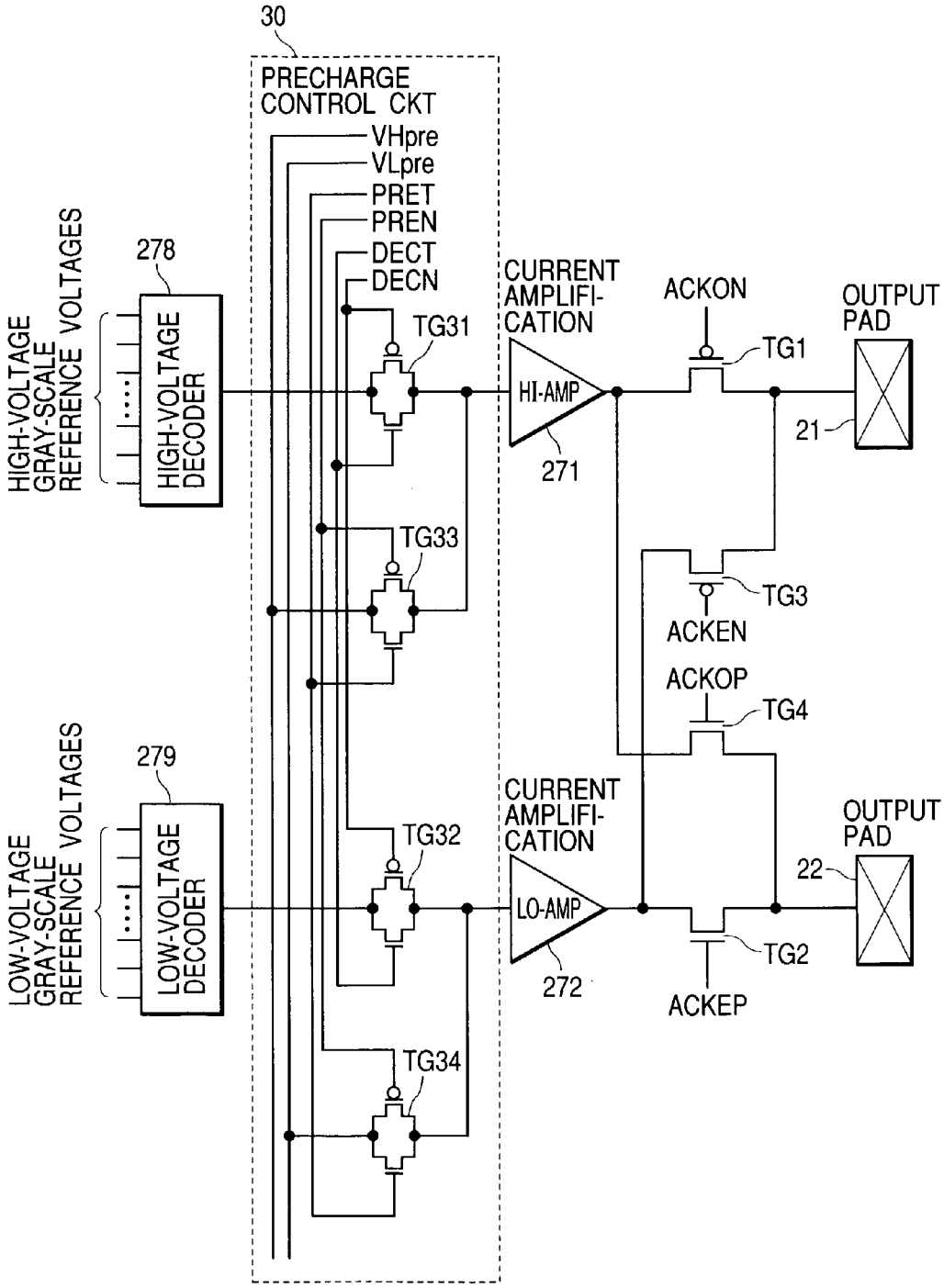
FIG. 6 is a diagram for explaining operation of he precharge circuit shown in FIG. 5.

FIG. 6 is a diagram for explaining the operation of the precharge circuit 30 shown in FIG. 5.

FIG. 6 shows only the high-voltage decoder circuit 278, the low-voltage decoder circuit 279, the high-voltage amplifier circuit 271 and the low-voltage amplifier circuit 272. FIG. 6 shows only an output system including two adjacent drain signal lines (D) for the same color, the first drain signal line (D1) and the fourth drain signal line (D4), for example.

As shown in FIG. 6, transfer gate circuits (TG1 to TG4) constitute part of the switch section (2) 264 of FIG. 5. Output pads (21, 22) represent output pads of a semiconductor chip (drain driver) coupled to the first drain signal line (D1) and the fourth drain signal line (D4), respectively, for example.

The precharge circuits 30 are provided between the high-voltage decoder circuit 278 and the high-voltage amplifier circuit 271, and between the low-voltage decoder circuit 279 and the low-voltage amplifier circuit 272.

The precharge circuit 30 includes a transfer circuit (TG31) connected between the high-voltage decoder circuit 278 and the high-voltage amplifier circuit 271, and includes a transfer gate (TG32) connected between the low-voltage decoder circuit 279 and the low-voltage amplifier circuit 272. These transfer gate circuits (TG31, TG32) are controlled by control signals (DECT, DECN), and during a precharge period, the high-voltage decoder circuit 278 and the low-voltage decoder circuit 279 are respectively disconnected from the high-voltage amplifier circuit 271 and the low-voltage amplifier circuit 272. The precharge circuit 30 also includes transfer gate circuits (TG33, TG34).

Figure 7:
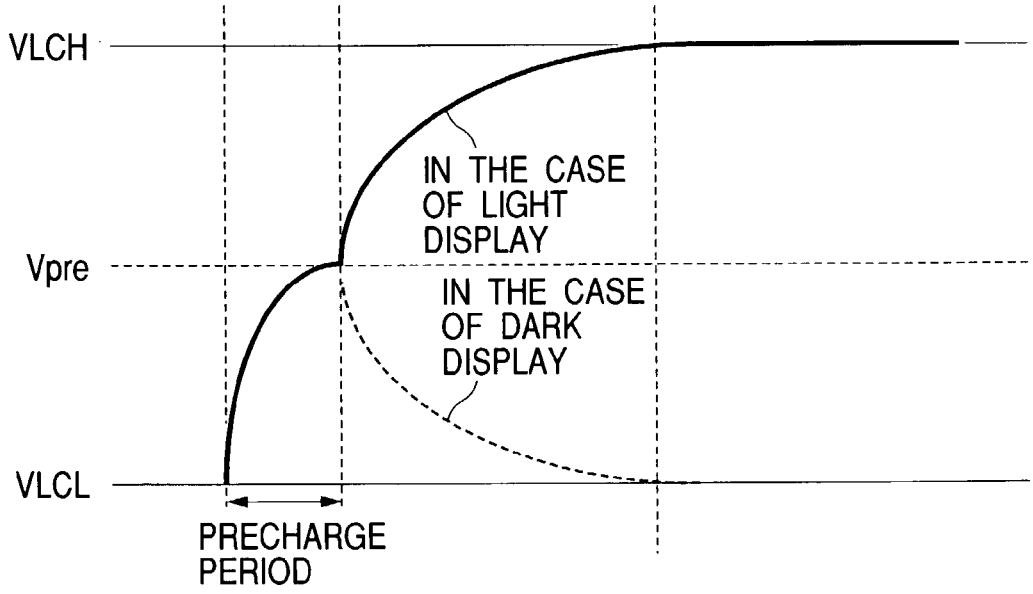
FIG. 7 is a diagram for explaining voltage waveforms of the drain signal line (D) of the liquid crystal display panel shown in FIG. 1.

These transfer gate circuits (TG33, TG34) are controlled by control signals (PRET, PREN), and during the precharge period the precharge circuit supplies a precharge voltage (hereinafter a high-voltage precharge voltage, e.g., an arbitrary positive-polarity gray-scale voltage) (VHpre) for application of positive-polarity gray-scale voltages, to the high-voltage amplifier circuit and also supplies a precharge voltage (hereinafter a low-voltage precharge voltage, e.g., an arbitrary negative-polarity gray-scale voltage) (VLpre) for application of negative-polarity gray-scale voltages, to the low-voltage amplifier circuit 272. FIG. 7 shows waveforms of the voltages on the drain signal line (D) in the liquid crystal display panel 10 shown in FIG. 1.

In the liquid crystal display module shown in FIG. 1, during the precharge period, the high-voltage decoder circuit 278 and the low-voltage decoder circuit are respectively disconnected from the high-voltage amplifier circuit 271 and the low-voltage amplifier circuit 272, and the high-voltage amplifier circuit 271 and the low-voltage amplifier circuit 272 are supplied with the high-voltage precharge voltage (VHpre) and the low-voltage precharge voltage (VLpre), respectively. Thus, the drain signal line (D) is charged to the high-voltage precharge voltage (VHpre) or the low-voltage precharge voltage (VLpre) beforehand.

The operation of precharging the drain signal lines (D) by the high-voltage amplifier circuit 271 and the low-voltage amplifier circuit 272 are performed simultaneously with the decoding operation by the high-voltage decoder circuit 278 and the low-voltage decoder circuit 279.

After the termination of the precharge period, the high-voltage amplifier circuit 271 and the low-voltage amplifier circuit 272 track the outputs of the high-voltage decoder circuit 278 and the low-voltage decoder circuit 279, respectively, and supply the gray-scale voltages (VLCH, VLCL) corresponding to the display data to the drain signal lines (D), respectively.

In this way, by charging the drain signal line (D) with the high-voltage precharge voltage (VHpre) or the low-voltage precharge voltage (VLpre) during the precharge period, the potential of the drain signal line (D) can track quickly gray-scale voltages corresponding to the display data after the termination of the precharge period.

Figure 8:
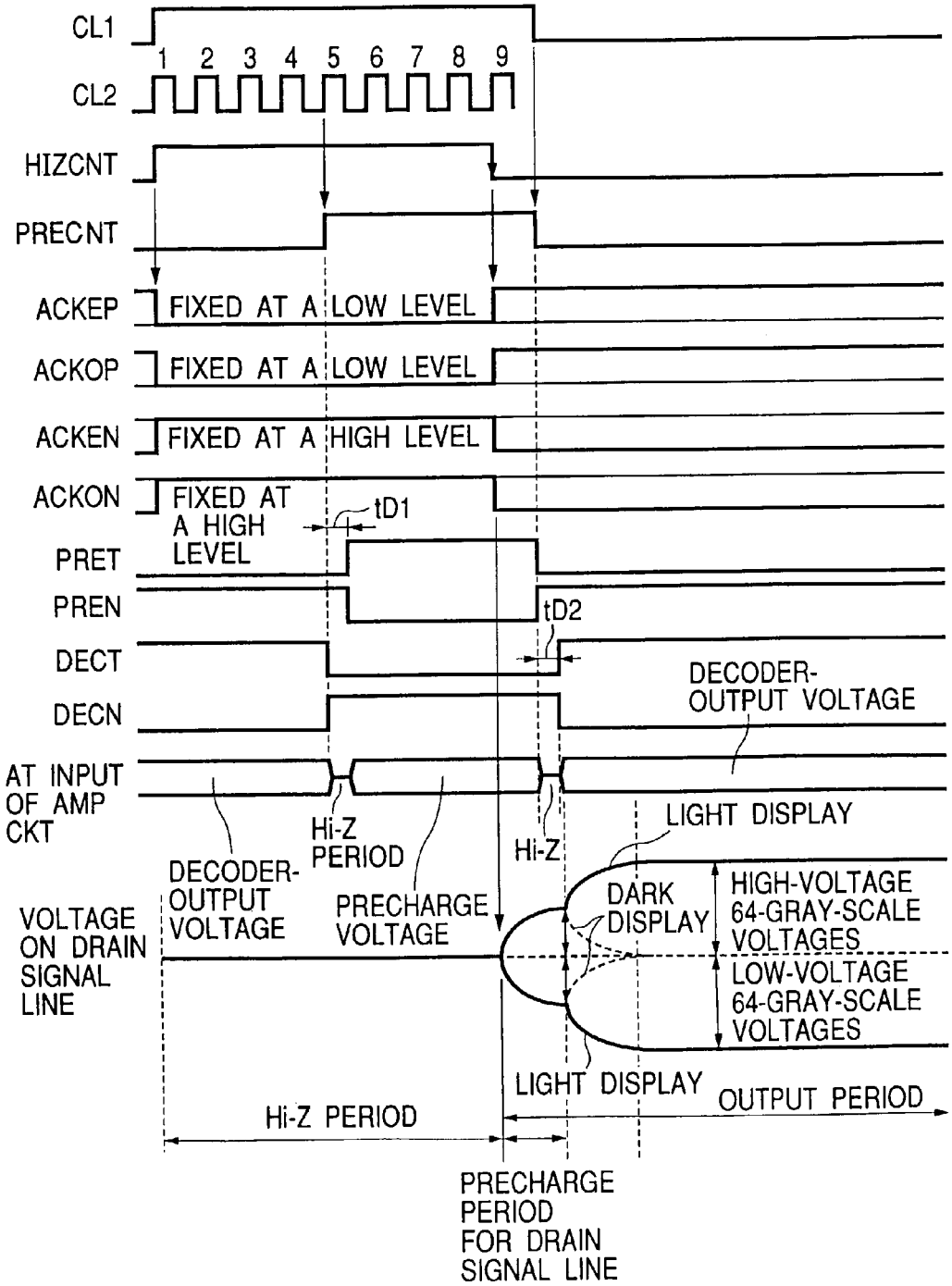
FIG. 8 shows an example of timing charts for explaining the operation of the precharge circuit shown in FIG. 6.

FIG. 8 shows an example of the timing chart of the precharge circuit 30 shown in FIG. 6. A control signal (HIZCNT) shown in FIG. 8 is one for generating control signals (ACKON, ACKEP, ACKEN, ACKOP) to be applied to gate electrodes of the transfer gate circuits (TG 1 to TG 4). The control signal (HIZCNT) is at a high level during a time equal to eight times the repetition period of the clock (CL2) within a time interval when a clock (CL1) is at a high level (hereinafter referred to simply as an H level). At a time of switching from one scanning line to the next one, both of the high-voltage amplifier circuit 271 and the low-voltage amplifier circuit 272 become unstable. The control signal (HIZCNT) is provided for preventing the respective amplifier circuits (271, 272) from outputting their outputs to respective drain signal lines (D) during the time required for switching between the scanning lines.

During the time interval when the control signal (HIZCNT) is at the H level, the control signals (ACKEP, ACKOP) are switched to a low level (hereinafter referred to as an L level), and the control signals (ACKEN, ACKON) are switched to a H level. Thereby, all the transfer gate circuits (TG1 to TG4) are switched off.

A control signal (PRECNT) shown in FIG. 8 is one for generating control signals (PRET, PREN, DECT, DECN) to be applied to gate electrodes of the transfer gate circuits (TG31 to TG34). The control signal (PRECNT) is switched to the H level at a time equal to four times the repetition period of the clock (CL2) after a rising edge of the control signal (HIZCNT), and is switched to the L level at a time of a falling edge of the clock (CL1).

The control signal (DECT) changes from the H level to the L level before the control signal (PREN) is switched from the H level to the L level. The control signal (DECN) changes from the L level to the H level before the control signal (PRET) is switched from L level to H level. Thereby, at first, the transfer gates (TG31, TG32) are switched off, and then, a time (tD1) after, the transfer gate circuits (TG33, TG34) are switched on.

The control signal (PREN) changes from the L level to the H level before the control signal (DECT) changes from the L level to the H level. The control signal (PRET) changes from the H level to the L level before the control signal (DECN) is switched from the H level to the L level. Thereby, at first, the transfer gate circuits (TG33, TG34) are switched off, and then, a time (tD2) after, the transfer gate circuits (TG31, TG32) are switched on.

As shown in FIG. 8, the precharge period is represented by a time from the falling edge of the control signal (HIZCNT) to the rising edge of the control signal (DECT), but actually a time during which the precharge voltage is applied to the drain signal line (D) is a time from the falling edge of the control signal (HIZCNT) to the falling edge of the control signal (PRET).

Voltage Value in the Precharge Circuit Shown in FIG. 6.

Figure 9B:
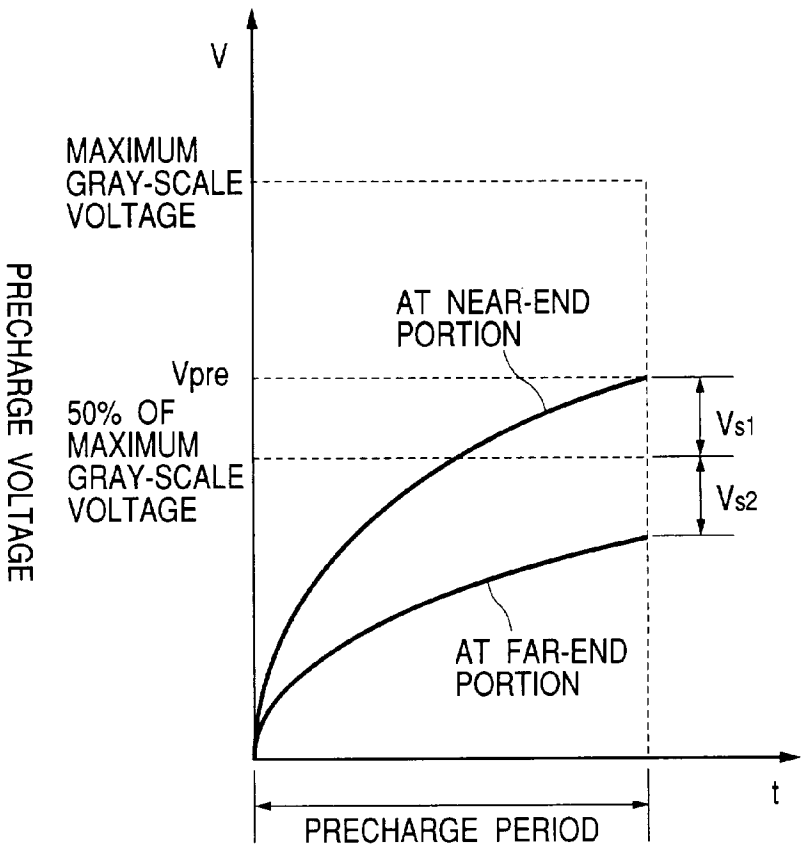
FIGS. 9A and 9B are graphs for explaining the voltage variations during a precharge period at the near-end portion of a drain signal line (D) proximate to the drain driver and at the far-end portion of the drain signal line (D) far from the drain driver.
Figure 9A:
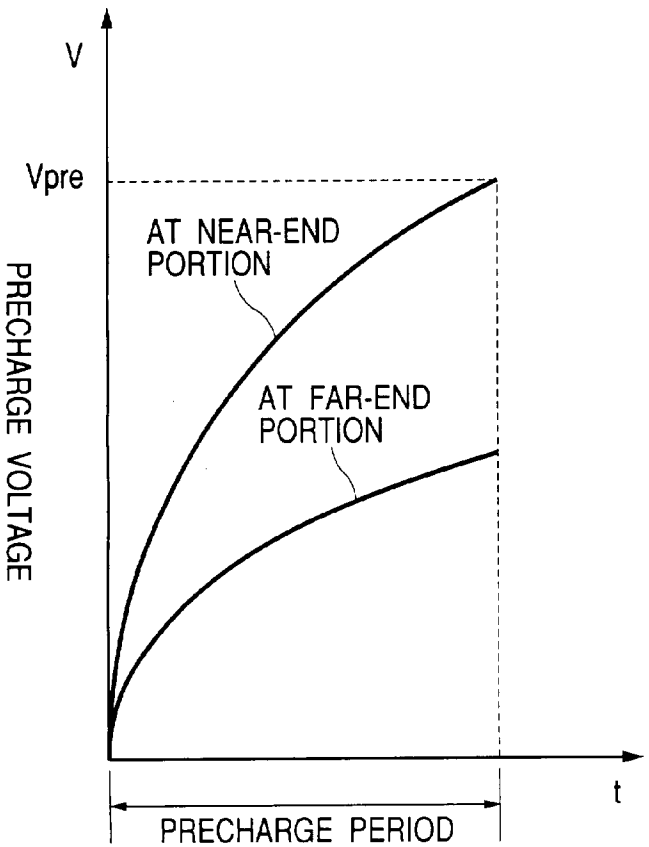

FIG. 9A is a graph for explaining the variations in potential at the near-end portion of a drain signal line proximate to the drain driver 130, and at the far-end portion of the drain signal line farthest from the drain driver 130 during the precharge period.

As is apparent from FIG. 9A, during the precharge period, when a precharge voltage (the high-voltage precharge voltage (VHpre), or the low-voltage precharge voltage (VLpre) is applied on a drain signal line (D), the potential variation at the near-end portion of the drain signal line proximate to the drain driver 130 differs from that at the far-end portion of the drain signal line farthest from the drain driver 130. In general, the midpoint of the positive-polarity gray scale voltage range is preferable for the high-voltage precharge voltage (VHpre).

However, in a case where the midpoint of the positive-polarity gray scale voltage range is adopted as the high-voltage precharge voltage (VHpre), as shown in FIG. 9A, the potential at the far-end portion of the drain signal line farthest from the drain driver 130 does not reach the midpoint of the positive-polarity gray scale voltage range.

Therefore, as shown in FIG. 9B, the high-voltage precharge voltage (VHpre) is selected such that the absolute value (Vs1) of the potential difference between the precharge voltage at the near-end portion of the drain signal line proximate to the drain driver 130 and the midpoint of the positive-polarity gray scale voltage range is equal to the absolute value (Vs2) of the potential difference between the precharge voltage at the far-end portion of the drain signal line farthest from the drain driver 130 and the midpoint of the positive-polarity gray scale voltage range, that is, Vs1=Vs2. That is to say, the high-voltage precharge voltage (VHpre) shown in FIG. 6 is selected to be a voltage displaced toward the maximum gray scale voltage from the midpoint of the positive-polarity gray scale voltage range. In the same manner, the low-voltage precharge voltage (VLpre) shown in FIG. 6 is selected to be a voltage displaced toward the maximum negative gray scale voltage from the midpoint of the negative-polarity gray scale voltage range.

Outline of the Present Invention

The liquid crystal display module shown in the present embodiments employs a two-line-inversion driving method.

Figure 10A:
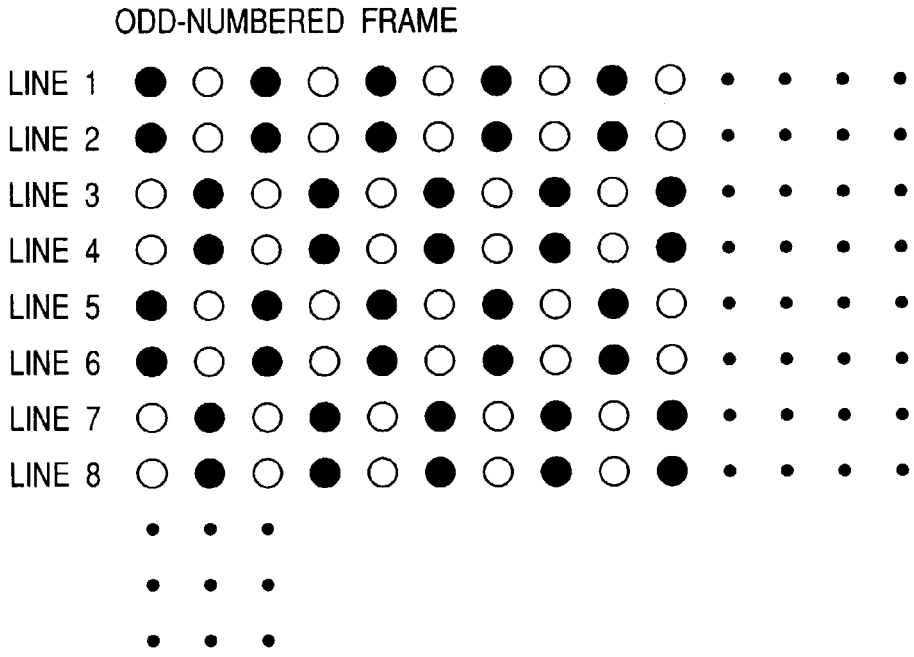
FIGS. 10A and 10B are diagrams for explaining polarities of a gray scale voltage supplied from the drain driver to the drain signal line (D) in the case where two-line inversion driving method is employed for driving the liquid crystal display module.
Figure 10B:
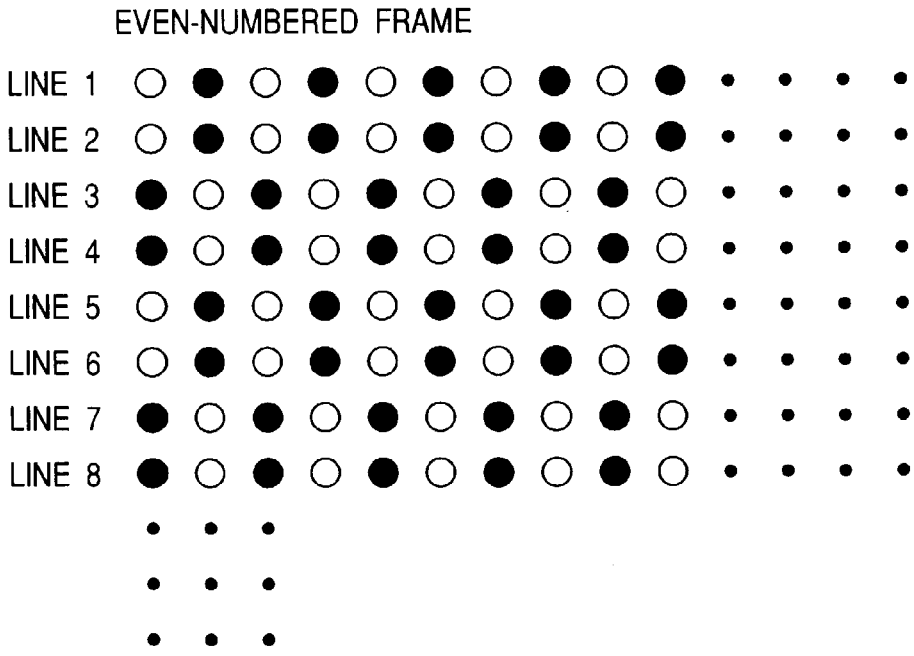

FIGS. 10A and 10B are illustrations for explaining the polarities of gray scale voltages (that is, gray scale voltages supplied to pixel electrodes) supplied to the drain signal lines (D) from the drain drivers 130, in a case where the two-line-inversion method is employed for a liquid crystal display module. In FIGS. 10A and 10B, positive-polarity gray scale voltages are denoted by open circles and negative-polarity gray scale voltages are denoted by solid circles.

Figure 16A:
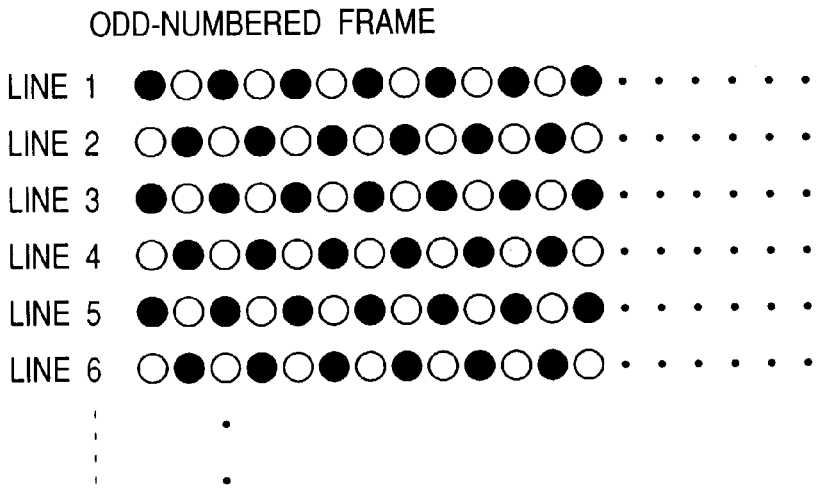
FIGS. 16A and 16B are diagrams for explaining polarities of the gray scale voltage supplied from a drain driver to the drain signal lines (D) in a case where a dot-inversion driving method is employed for a liquid crystal display module.
Figure 16B:
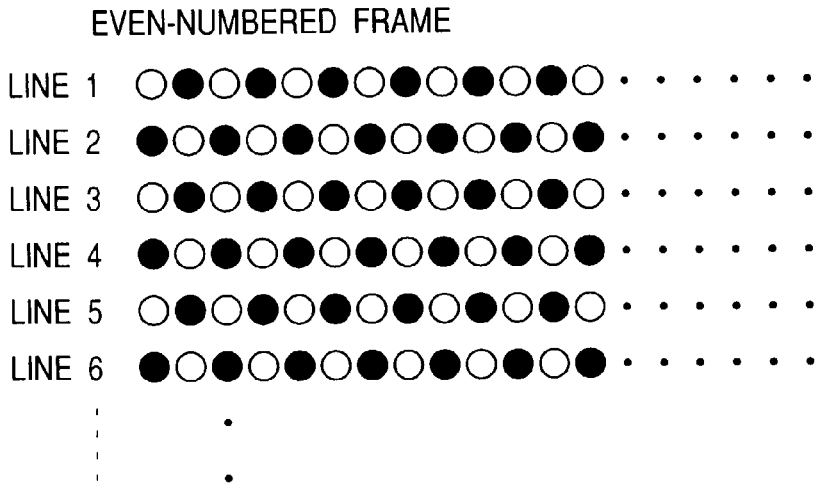
Figure 17:
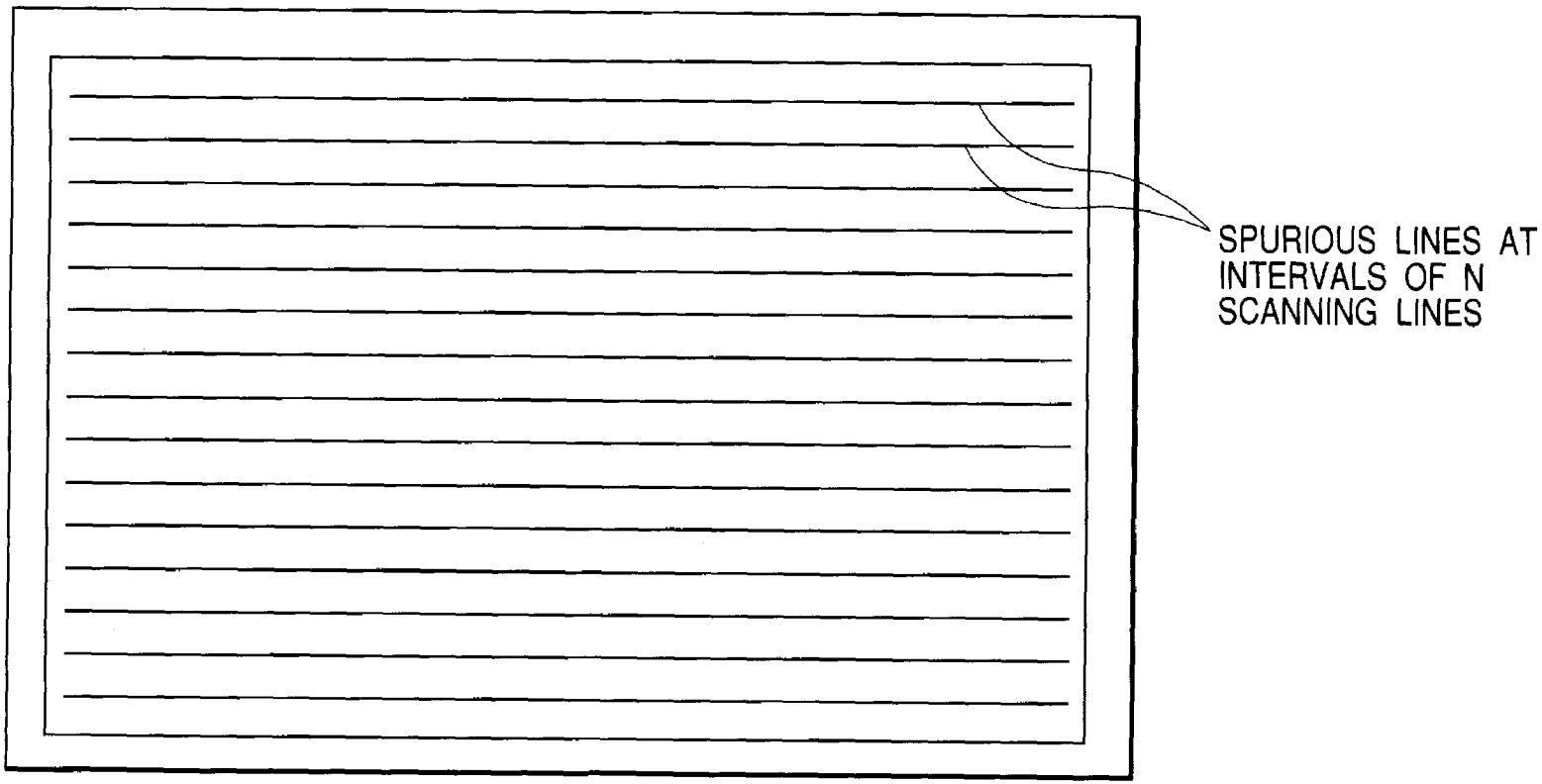
FIG. 17 is a schematic diagram showing spurious horizontal lines appearing at intervals of N scanning lines on a liquid crystal display panel in a case where a two-line inversion driving method is employed.

The two-line-inversion driving method is similar to the dot inversion driving method explained in connection with FIGS. 16A and 16B, except that the polarities of the gray scale voltages supplied to the drain signal lines (D) from the drain drivers 130 are inverted every two scanning lines, and therefore its detailed explanation is omitted.

For example, in a case where a picture having an area of the same gray scale level ranging over several scanning lines is displayed on the liquid crystal display panel 10, with the two-line-inversion driving method, the drain driver 130 outputs gray scale voltages whose polarities are inverted every 2 scanning lines to the drain signal lines (D).

Figure 11:
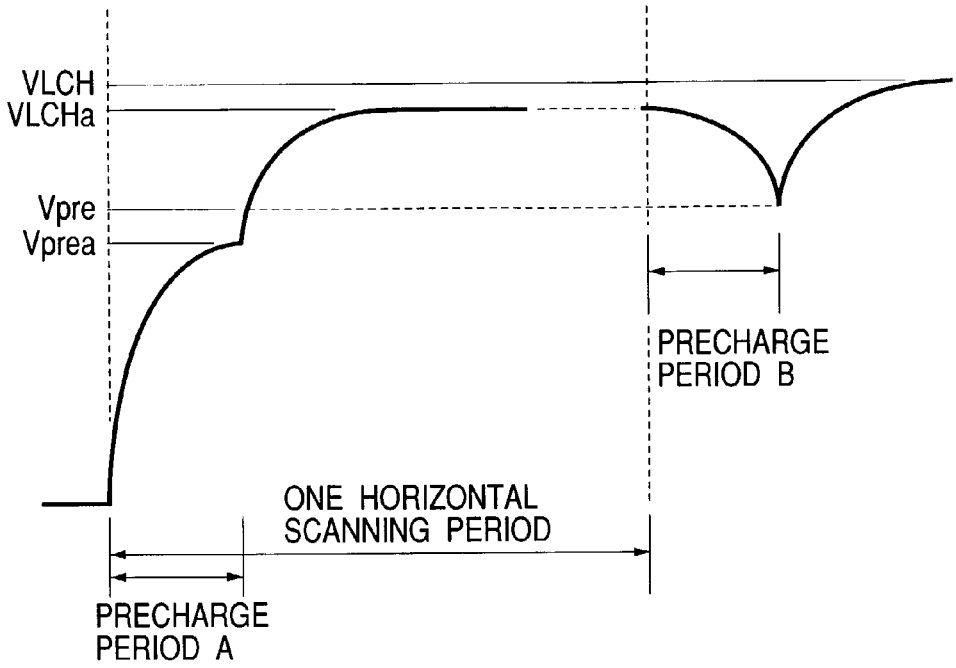
FIG. 11 is a diagram for explaining a cause for occurrence of spurious horizontal lines in the displayed image when the two-line inversion driving method is employed for a liquid crystal display module.

The following explains by referring to FIG. 11 the reason why the above-mentioned spurious horizontal lines occur when the two-line-inversion driving method is employed.

Now consider a case where the polarity of the gray scale voltage supplied to the drain signal lines (D) from the drain driver 130 changes from negative to positive.

In this case, the gray scale voltages on the drain signal lines (D) are negative in polarity before the inversion of the polarities, and after the inversion of the polarities, the gray scale voltages become positive in polarity, but, since the drain signal lines (D) can be regarded as distributed constant lines, the gray scale voltages on the drain signal lines cannot change from negative to positive in polarity immediately, and consequently, the voltages on the drain signal lines (D) change from the negative-polarity gray scale voltages to the positive-polarity gray scale voltages after some time delay.

Therefore, even if a precharge voltage (Vpre) is applied to the drain signal lines (D) during a precharge period A indicated in FIG. 11, the drain signal lines (D) will be charged up to a voltage Vprea lower than the precharge voltage (Vpre), and therefore even if the gray scale voltage VLCH is applied to the drain signal lines (D) after the precharge period, the voltage on the drain signal lines (D) will be a voltage VLCHa lower than the gray scale voltage VLCH. Next consider a scanning line, for example, Line 4 in FIG. 10A, succeeding to a scanning line, for example, Line 3 in FIG. 10A, immediately after inversion of voltage polarity. The polarity of a gray scale voltage for Line 4 supplied to the drain signal lines (D) from the drain driver 130 is the same as the polarity of a gray scale voltage for Line 3 having been supplied to the drain signal lines. Therefore application of the precharge voltage (Vpre) during the precharge period B shown in FIG. 11 charges up the drain signal lines (D) to the precharge voltage (vpre). Thereafter, when the gray scale voltage VLCH is applied to the drain signal lines (D), the drain signal lines (D) are charged up to the gray scale voltage VLCH.

The above-explained phenomenon occurs when the drain driver 130 switches the polarity of the gray scale voltages for the drain signal lines (D) from positive to negative.

Therefore, even when pixels on the scanning line LINE 4 are intended to display the same gray scale level as pixels on the scanning line LINE 3 immediately after the polarity inversion, the voltage written into the pixels on the scanning line LINE 4 are not the same as the voltage written into the pixels on the scanning line LINE 3 with a voltage difference (VLCH−VLCHa) indicated in FIG. 11, and consequently, the above-mentioned spurious horizontal lines appear at intervals of two scanning lines.

The spurious horizontal lines become conspicuous when resolution of the liquid display panel 10 is increased as in the case of the SXGA display mode of 1280×1024 pixels, the UXGA display mode of 1600×1200 pixels, or the like.

As described in the above, the spurious horizontal lines occur due to the difference between the voltages written into pixels on the scanning line (LINE 3, for example) immediately after the polarity inversion and the voltages written into pixels on the scanning line (LINE 4, for example) succeeding the scanning line (LINE 3) immediately after the polarity inversion to the above scanning line (LINE 3).

Figure 12:
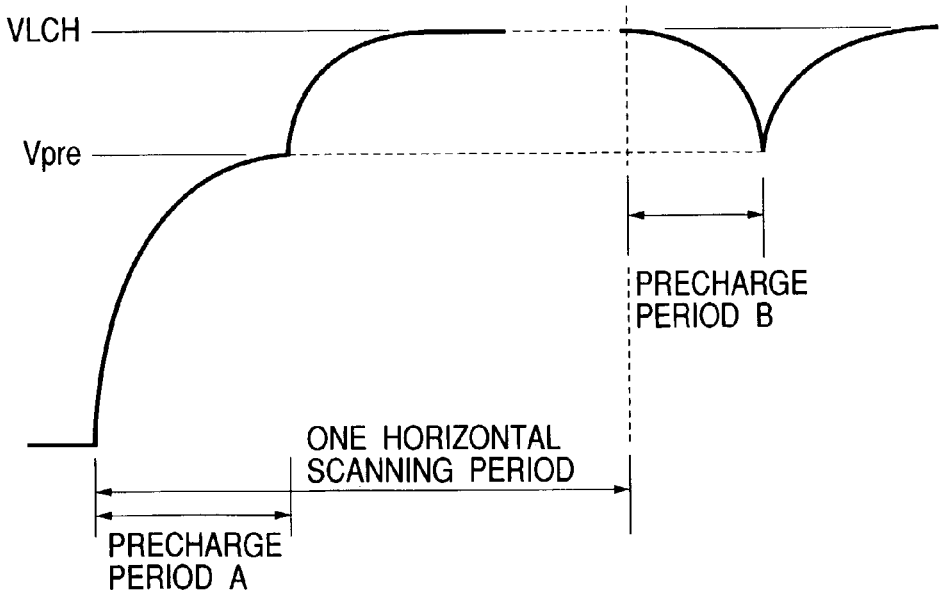
FIG. 12 is a diagram for explaining the outline of the driving method according to the present invention.

In the present invention, as shown in FIG. 12, the precharge period A for a scanning line immediately after inversion of voltage polarity (for example, LINE 3 shown in FIG. 10A) is made different from the precharge period B for a scanning line (for example, LINE 4 shown in FIG. 10A) succeeding to the scanning line (LINE 3) immediately after inversion of voltage polarity. With this configuration, the voltages written into the pixels on the scanning line (LINE 3) immediately after the inversion of voltage polarity are made equal to the voltages written into the pixels on the scanning line (LINE 4) succeeding the scanning line (LINE 3) immediately after inversion of voltage polarity.

That is to say, the precharge period A for the scanning line (LINE 3) immediately after the inversion of voltage polarity is made longer than the precharge period B for the scanning line (LINE 4) succeeding the scanning line (LINE 3) immediately after the inversion of voltage polarity. This configuration makes it possible to charge the drain signal lines (D) to the precharge voltage (Vpre) during the precharge period A and the precharge period B shown in FIG. 12, respectively, and consequently, the voltages written into the pixels on the scanning line (LINE 3) immediately after the inversion of voltage polarity are made equal to the voltages written into the pixels on the scanning line (LINE 4) succeeding the scanning line (LINE 3) immediately after the inversion of voltage polarity.

Further, a duration of a high (H) level of a clock (CL1) for a scanning line farthest from the drain driver 130 is selected to be longest, and the durations of the H level of the clock (CL1) for the scanning lines are made successively shorter as the scanning lines approach the drain driver 130 such that the precharge period for the scanning lines becomes longer with increasing distance from the drain driver 130 to the scanning lines. By applying the precharge voltages of the above configuration on the drain signal lines (D), the charged voltage at the near-end portion of the drain signal line (D) proximate to the drain driver 130 is made equal to the charged voltage at the far-end portion of the drain signal line (D) farthest from the drain driver 130.

Features of the Liquid Crystal Display Module of the Embodiments in Accordance with the Present Invention In this embodiment according to the present invention, for the purpose of making the precharge period A for the scanning line immediately after the inversion of voltage polarity longer than the precharge period B for the scanning line succeeding the scanning line immediately after the inversion of voltage polarity, the duration of the H level of the clock (CL1) for the precharge period A is made longer than that of the H level of the clock (CL1) for the precharge period B.

As explained in connection with FIG. 8, the actual period of time during which the precharge voltage is applied on the drain signal line (D) is a time from the falling edge of the control signal (HIZCNT) to the falling edge of the control signal (PRET). The falling edge of the control signal (PRET) coincides in time with the falling edge of the clock (CL1). Therefore the time during which the precharge voltage is applied on the drain signal line (D) by lengthening the duration of the H level of the clock (CL1), and consequently, the precharge period can be increased as illustrated in FIG. 8. In this way, the present embodiment makes it possible to lengthen the precharge period without changing the internal configuration of the drain driver 130.

Figure 13:
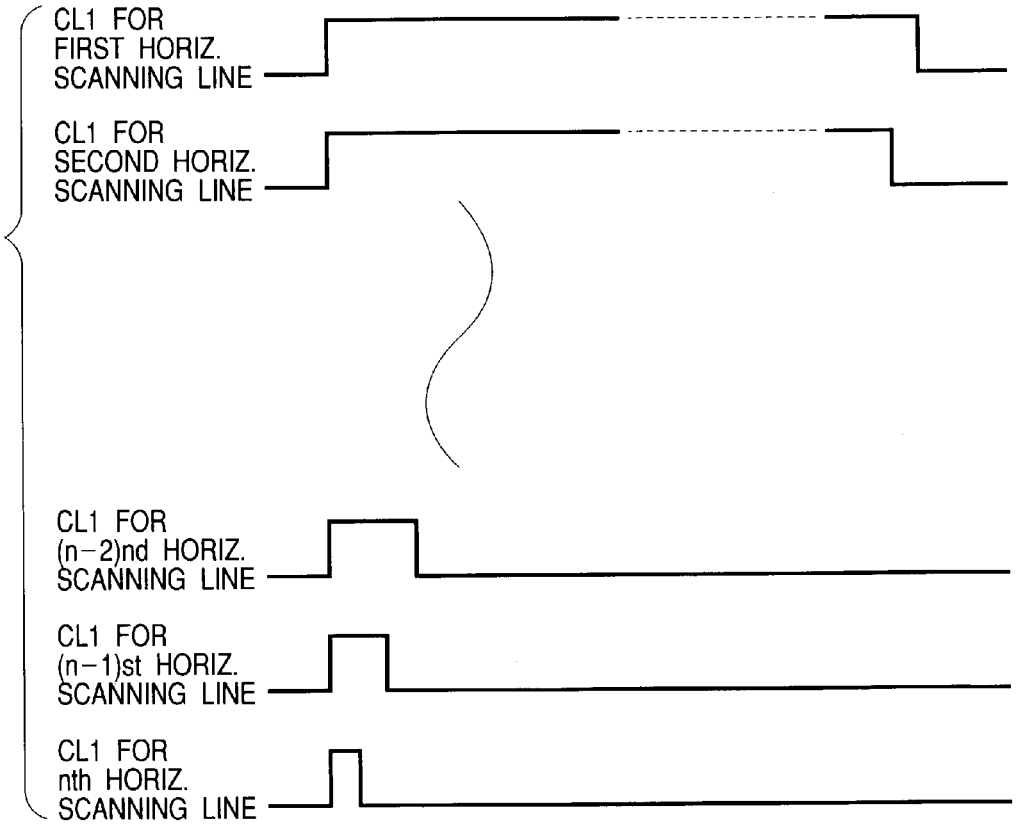
FIG. 13 is a diagram for explaining the H level period of a clock pulse (CL1) for each of the scanning lines in an embodiment according to the present invention.

As shown in FIG. 13, in application of the gray scale voltages on pixels on the respective scanning lines, the duration the H level of the clock (CL1) for the scanning line (illustrated as the first (top) scanning line in FIG. 13 and also see FIG. 1) farthest from the drain driver 130 is made longest, and the durations of the H level of the clocks (CL1) for the respective scanning signal lines are made successively shorter as the scanning lines approach the drain driver 130. That is to say, the precharge periods for the respective scanning lines are made longer with increase in distance from the drain driver 130 to the respective scanning lines. Consequently, by applying the above-explained precharge voltages on the drain signal lines (D), the voltage charged at the near-end portion of the drain signal line proximate to the drain driver 130 can be made equal to the voltage charged at the far-end portion of the drain signal line farthest from the drain driver 130.

The following explains the configuration of the display control device 110 for varying the duration of the clock (CL1) H level.

Figure 14:
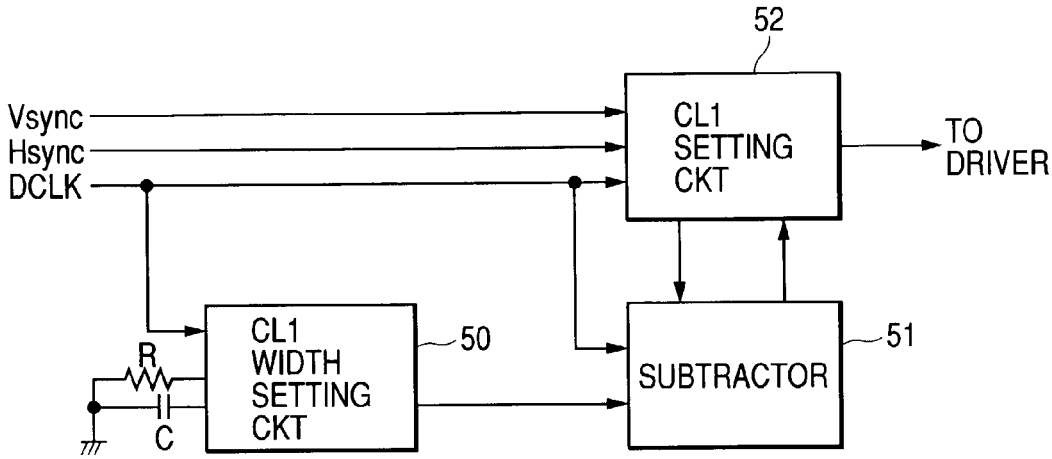
FIG. 14 is a block diagram showing a clock (CL1) generator circuit in an embodiment according to the present invention.

FIG. 14 is a block diagram illustrating a clock (CL1) generator circuit in the present embodiment.

In a CL1 H-level width setting circuit 50 of the present embodiment, the number of clock pulses (hereinafter called the maximum number of clock pulses) of an external clock (DCLK) is set such that the maximum number of clock pulses corresponds to the maximum width (the width of the H level of a clock (CL1) required for the first (top) scanning line shown in FIG. 13) of the H level of the clock (CL 1). In the CL1 H-level width setting circuit 50, an oscillator circuit including a resister R and a capacitor C as its oscillator elements is adjusted such that its oscillation frequency corresponds to the above-mentioned maximum number of clock pulses. A subtractor 51 subtracts the number of clock pulses of the external clock (DCLK) assigned to each of the scanning lines from the maximum number of clock pulses. A CL1 setting circuit 52 reads out the remainder after the subtraction from the subtractor 51, and switches the H level of the clock (CL1) into the low (L) level when the counted number of clock pulses of the external clock (DCLK) reaches the remainder of clock pulses after the subtraction. This operation generates clocks (CL1) having the respective widths of the H level as illustrated in FIG. 13.

The following explains a method of generating an AC driving signal (M) in the present embodiment.

Figure 15:
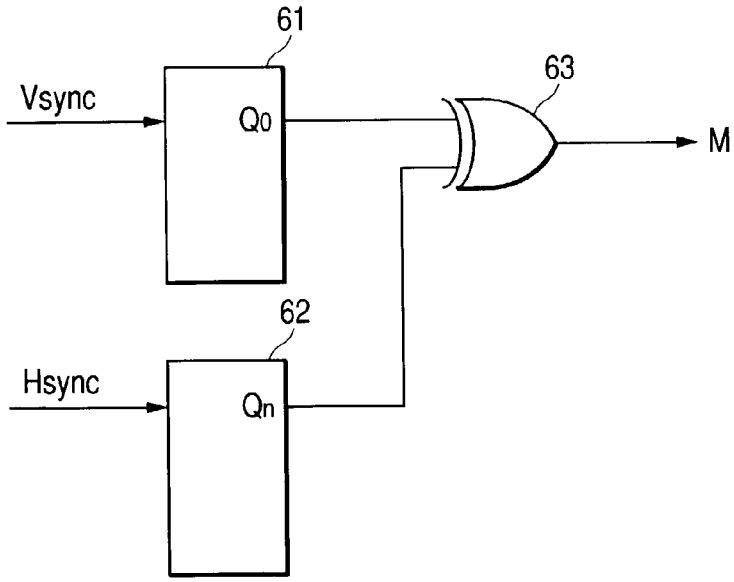
FIG. 15 is a circuit diagram showing the circuit configuration for generating an ac-driving signal (M) in the liquid crystal display module in an embodiment according to the present invention.

FIG. 15 is a circuit diagram illustrating a circuit configuration for generating the AC driving signal (M) in the present embodiment. The circuit shown in FIG. 15 is provided within the display control device 110.

As shown in FIG. 15, a counter 61 counts pulses of a vertical sync signal (Vsync) and supplies its Q0 output to an exclusive OR circuit 63. The Q0 output of the counter 61 supplies the H level and the L level signals alternately for each of pulses of the vertical sync signal (Vsync).

The Qn output of the counter 62 is input to the exclusive OR circuit 63, and the output of the exclusive OR circuit is provided as the AC driving signal (M).

As explained above, in the present embodiment the precharge period A for the scanning line immediately after the inversion of voltage polarity is made longer than the precharge period B for the scanning line succeeding the scanning line immediately after the inversion of voltage polarity, thereby the voltages applied on pixels on the scanning line immediately after the inversion of voltage polarity is made equal to the voltages applied on pixels on the scanning line succeeding the scanning line immediately after the inversion of voltage polarity, and consequently, occurrence of the above-explained spurious horizontal lines is prevented.

Further, the duration of the H level of the clock (CL1) is made longest for the scanning line farthest from the drain driver 130, and the durations of the H level of the clock (CL1) for the respective scanning lines are made successively shorter with decreasing distance from the respective scanning lines to the drain driver 130 such that the precharge periods for the respective scanning lines are made longer with increasing distance from the respective scanning lines to the drain driver 130, and consequently, the charged voltage at the near-end portion of the drain signal line (D) proximate to the drain driver 130 can be made equal to the charged voltage at the far-end portion of the drain signal line (D) farthest from the drain driver 130. This prevents severe degradation in quality of a display on the liquid display panel caused by insufficiency of the voltage level for writing into the pixels at the far-end portion of the drain signal line farthest from the drain driver 130.

Further, in the present embodiment, the high-voltage precharge voltage (VHpre) can be selected to be a midpoint of the positive-polarity gray scale voltage range, and the low-voltage precharge voltage (VLpre) can be selected to be a midpoint of the negative-polarity gray scale voltage range.

However, the high-voltage precharge voltage (VHpre) can be selected to be a voltage displaced toward the maximum gray scale voltage from the midpoint of the positive-polarity gray scale voltage range, and the low-voltage precharge voltage (VLpre) can be selected to be a voltage displaced toward the maximum negative gray scale voltage from the midpoint of the negative-polarity gray scale voltage range. This configuration ensures more that the charged voltage at the far-end portion of the drain signal line (D) farthest from the drain driver 130 is made equal to the charged voltage at the near-end portion of the drain signal line (D) proximate to the drain driver 130.

The above description explained the embodiments in which the present invention is applied to the liquid crystal display panel of the vertical electric field type. However, the present invention is not limited to this and it can be applied to the liquid crystal display panel of the horizontal electric field type.

In the liquid crystal display device of the horizontal electric field type (commonly called the in-plane switching (IPS) type), the transmission of light at each pixel is controlled by a horizontal electric field applied in parallel with a layer of liquid crystal material sandwiched between a pair of opposing transparent substrates. Each pixel is formed by two electrodes formed on the inner surface of one of the opposing transparent substrates. For the purpose of device construction and operation, U.S. Pat. No. 5,598,285, issued to Kondo et al. on Jan. 28, 1997, is hereby incorporated by reference.

In the case of the liquid crystal display panel of the vertical electric field type shown in FIG. 2 or FIG. 3, the common electrode (ITO2) is provided on a substrate opposing to a TFT substrate. On the other hand, in the case of the liquid crystal display panel of the horizontal electric field type, there are provided a counter electrode (CT) and a counter-electrode-signal line (CL) for applying a common voltage (Vcom) on the counter electrode on the TFT substrate. An equivalent liquid-crystal-formed capacitance (Cpix) formed by the liquid crystal layer is connected between the pixel electrode (PX) and the counter electrode (CT). The storage capacitance (Cstg) is also formed between the pixel electrode (PX) and the counter electrode CT).

The invention made by the present inventor has been explained concretely based on the preferred embodiments according to the present invention, but the present invention is not limited to the above-mentioned preferred embodiments, and they are illustrative and not restrictive, and various kinds of modifications may be made without departing from the scope and spirit of the invention.

The advantages provided by representative ones of the present inventions disclosed in the present specification will be simply explained in the following.

(1) In a case where the polarities of the gray-scale voltages are inverted every N ($N \geqq 2$) scanning lines, the present invention is capable of preventing occurrence of spurious horizontal lines on a display screen and thereby improving quality of a display on the display screen.

(2) The present invention is capable of reducing a difference between a charged voltage at the near-end portion of the drain signal line proximate to the drain driver and a charged voltage at the far-end portion of the drain signal farthest from the drain driver, during the precharge period, as compared with the conventional technique, and thereby improving quality of a display on the display screen.

What is claimed is:

1. A method of driving a liquid crystal display device, said liquid crystal display device including a liquid crystal layer, a plurality of pixels arranged in a matrix configuration, each of said plurality of pixels being provided with a pixel electrode for generating an electric field in said liquid crystal layer between said pixel electrode and a common electrode associated with said plurality of pixels in common, a plurality of video signal lines coupled to said plurality of pixels, a plurality of scanning lines arranged to intersect said plurality of video signal lines and coupled to said plurality of pixels, and a driver circuit for outputting a charging voltage during a charging period at a beginning of a horizontal scanning period and continuously outputting a gray scale voltage corresponding to a display data to said plurality of video signal lines during a remaining portion of said horizontal scanning period, said method comprising:

applying a common voltage to said common electrode;

applying a same polarity of gray scale voltages to said video signal lines corresponding to successive N horizontal scanning periods, where N≧2;

inverting a polarity of said gray scale voltage with respect to a common voltage on said common electrode successive N horizontal scanning periods, where N≧2; and making a first charging period of said charging voltage corresponding to a first line of N lines of said plurality of scanning lines scanned immediately after inversion of said polarity of said gray scale voltage different from a second charging period of said charging voltage corresponding to a second line of said N lines scanned immediately succeeding said first line.

2. A method of driving a liquid crystal display device according to claim 1, wherein said first charging period is longer than said second charging period.

3. A method of driving a liquid crystal display device according to claim 1, wherein said charging voltage is displaced toward a maximum gray scale voltage from a value of (said maximum gray scale voltage+a minimum gray scale voltage)/2, where said maximum gray scale voltage is a greatest value in a range of said gray scale voltage of one polarity with respect to said common voltage, and said minimum gray scale voltage is a smallest value in said range of said gray scale voltage of said one polarity with respect to said common voltage.

4. A method of driving a liquid crystal display device according to claim 1, wherein said charging voltage is (a maximum gray scale voltage+a minimum gray scale voltage)/2, where said maximum gray scale voltage is a greatest value in a range of said gray scale voltage of one polarity with respect to said common voltage, and said minimum gray scale voltage is a smallest value in said range of said gray scale voltage of said one polarity with respect to said common voltage.

5. A method of driving a liquid crystal display device according to claim 1, wherein said N is two.

6. A method of driving a liquid crystal display device, said liquid crystal display device including a liquid crystal layer, a plurality of pixels arranged in a matrix configuration, each of said plurality of pixels being provided with a pixel electrode for generating an electric field in said liquid crystal layer between said pixel electrode and a common electrode associated with said plurality of pixels in common, a plurality of video signal lines coupled to said plurality of pixels, a plurality of scanning lines arranged to intersect said plurality of video signal lines and coupled to said plurality of pixels, and a driver circuit for outputting a charging voltage during a charging period at a beginning of a horizontal scanning period and then a gray scale voltage corresponding to a display data to said plurality of video signal lines after said charging period, said method comprising varying a charging period of said charging voltage with a distance from said driver circuit to a scanned one of said plurality of scanning lines.

7. A method of driving a liquid crystal display device according to claim 6, wherein said charging period increases with increasing distance from said driver circuit to a scanned one of said plurality of scanning lines.

8. A method of driving a liquid crystal display device according to claim 6, wherein a polarity of said gray scale voltage with respect to a common voltage on said common electrode is inverted adjacent N lines of said plurality of scanning lines, where N≧2, and a first one of said charging period of said charging voltage corresponding to a first line of N lines of said plurality of scanning lines scanned immediately after inversion of said polarity of said gray scale voltage is longer than a second one of said charging period of said charging voltage corresponding to a second line of said N lines scanned immediately succeeding said first line.

9. A method of driving a liquid crystal display device according to claim 8, wherein said N is two.

10. A method of driving a liquid crystal display device according to claim 6, wherein said charging voltage is displaced toward a maximum gray scale voltage from a value of (said maximum gray scale voltage+a minimum gray scale voltage)/2, where said maximum gray scale voltage is a greatest value in a range of said gray scale voltage of one polarity with respect to said common voltage, and said minimum gray scale voltage is a smallest value in said range of said gray scale voltage of said one polarity with respect to said common voltage.

11. A method of driving a liquid crystal display device according to claim 6, wherein said charging voltage is (a maximum gray scale voltage+a minimum gray scale voltage)/2, where said maximum gray scale voltage is a greatest value in a range of said gray scale voltage of one polarity with respect to said common voltage, and said minimum gray scale voltage is a smallest value in said range of said gray scale voltage of said one polarity with respect to said common voltage.

12. A method of driving a liquid crystal display device, said liquid crystal display device including a liquid crystal layer, a plurality of pixels arranged in a matrix configuration, each of said plurality of pixels being provided with a pixel electrode for generating an electric field in said liquid crystal layer between said pixel electrode and a common electrode associated with said plurality of pixels in common, a plurality of video signal lines coupled to said plurality of pixels, a plurality of scanning lines arranged to intersect said plurality of video signal lines and coupled to said plurality of pixels, a driver circuit for outputting a charging voltage during a charging period at a beginning of a horizontal scanning period and then a gray scale voltage corresponding to a display data to said plurality of video signal lines after said charging period, and a display control device for outputting an ac-driving signal for controlling ac-driving of said liquid crystal layer and for outputting a charge-control clock to said driver circuit, said method comprising:

inverting a polarity of said gray scale voltage with respect to a common voltage on said common electrode successive N lines of said plurality of scanning lines based upon said ac-driving signal, where N≧2; and varying a duration of a first level of said charge-control clock with time such that a first charging period of said charging voltage corresponding to a first line of N lines of said plurality of scanning lines scanned immediately after inversion of said polarity of said gray scale voltage is different from a second charging period of said charging voltage corresponding to a second line of said N lines scanned immediately succeeding said first line.

13. A method of driving a liquid crystal display device according to claim 12, wherein said duration of said first level of said charge-control clock corresponding to said first charging period is longer than said duration of said first level of said charge-control signal corresponding to said second charging period.

14. A method of driving a liquid crystal display device according to claim 12, wherein said charging voltage is displaced toward a maximum gray scale voltage from a value of (said maximum gray scale voltage+a minimum gray scale voltage)/2, where said maximum gray scale voltage is a greatest value in a range of said gray scale voltage of one polarity with respect to said common voltage, and said minimum gray scale voltage is a smallest value in said range of said gray scale voltage of said one polarity with respect to said common voltage.

15. A method of driving a liquid crystal display device according to claim 12, wherein said charging voltage is (a maximum gray scale voltage+a minimum gray scale voltage)/2, where said maximum gray scale voltage is a greatest value in a range of said gray scale voltage of one polarity with respect to said common voltage, and said minimum gray scale voltage is a smallest value in said range of said gray scale voltage of said one polarity with respect to said common voltage.

16. A method of driving a liquid crystal display device according to claim 12, wherein said N is two.

17. A method of driving a liquid crystal display device, said liquid crystal display device including a liquid crystal layer, a plurality of pixels arranged in a matrix configuration, each of said plurality of pixels being provided with a pixel electrode for generating an electric field in said liquid crystal layer between said pixel electrode and a common electrode associated with said plurality of pixels in common, a plurality of video signal lines coupled to said plurality of pixels, a plurality of scanning lines arranged to intersect said plurality of video signal lines and coupled to said plurality of pixels, a driver circuit for outputting a charging voltage during a charging period at a beginning of a horizontal scanning period and then a gray scale voltage corresponding to a display data to said plurality of video signal lines during a remaining portion of said horizontal scanning period, and a display control device for outputting a charge-control clock to said driver circuit, said method comprising varying a duration of a first level of said charge-control clock with time such that a charging period of said charging voltage varies with a distance from said driver circuit to a scanned one of said plurality of scanning lines.

18. A method of driving a liquid crystal display device according to claim 17, wherein said duration of said first level increases with increasing distance from said driver circuit to a scanned one of said plurality of scanning lines.

19. A method of driving a liquid crystal display device according to claim 17, wherein said display control device outputs an ac-driving signal for controlling ac-driving of said liquid crystal layer to said driver circuit, a polarity of said scale voltage with respect to a common voltage on said common electrode is inverted adjacent N lines of said plurality of scanning lines based upon said ac-driving signal, where N≧2, and a first one of said charging period of said charging voltage corresponding to a first line of N lines of said plurality of scanning lines scanned immediately after inversion of said polarity of said gray scale voltage is longer than a second one of said charging period of said charging voltage corresponding to a second line of said N lines scanned immediately succeeding said first scanning line.

20. A method of driving a liquid crystal display device according to claim 19, wherein said N is two.

21. A method of driving a liquid crystal display device according to claim 17, wherein said charging voltage is displaced toward a maximum gray scale voltage from a value of (said maximum gray scale voltage+a minimum gray scale voltage)/2, where said maximum gray scale voltage is a greatest value in a range of said gray scale voltage of one polarity with respect to said common voltage, and said minimum gray scale voltage is a smallest value in said range of said gray scale voltage of said one polarity with respect to said common voltage.

22. A method of driving a liquid crystal display device according to claim 17, wherein said charging voltage is (a maximum gray scale voltage+a minimum gray scale voltage)/2, where said maximum gray scale voltage is a greatest value in a range of said gray scale voltage of one polarity with respect to said common voltage, and said minimum gray scale voltage is a smallest value in said range of said gray scale voltage of said one polarity with respect to said common voltage.

23. A liquid crystal display device comprising:

a liquid crystal layer;

a plurality of pixels arranged in a matrix configuration, each of said plurality of pixels being provided with a pixel electrode for generating an electric field in said liquid crystal layer between said pixel electrode and a common electrode associated with said plurality of pixels in common;

a plurality of video signal lines coupled to said plurality of pixels;

a plurality of scanning lines arranged to intersect said plurality of video signal lines and coupled to said plurality of pixels;

a driver circuit for outputting a charging voltage during a charging period at a beginning of a horizontal scanning period and then a gray scale voltage corresponding to a display data to said plurality of video signal lines during a portion of said horizontal scanning period following said charging period; and a display control device for outputting an ac-driving signal for controlling ac-driving of said liquid crystal layer and for outputting a charge-control clock to said driver circuit, wherein said display control device is provided with a pulse-duration-varying circuit for varying a duration of a first level of said charge-control clock, and said driver circuit includes:

a polarity-inverting circuit for inverting a polarity of said gray scale voltage with respect to a common voltage on said common electrode adjacent N lines of said plurality of scanning lines based upon said ac-driving signal, where N≧2, and a charging-time control circuit for controlling a charging period of said charging voltage based upon said duration of said first level of said charge-control clock such that a first charging period of said charging voltage corresponding to a first line of N lines of said plurality of scanning lines scanned immediately after inversion of said polarity of said gray scale voltage is different from a second charging period of said charging voltage corresponding to a second line of said N lines scanned immediately succeeding said first line.

24. A liquid crystal display device according to claim 23, wherein a duration of said first level of said charge-control clock corresponding to said first charging period is longer than that corresponding to said second charging period.

25. A liquid crystal display device according to claim 23, wherein said N is two.

26. A liquid crystal display device according to claim 23, wherein said pulse-duration-varying circuit includes:

a maximum-clock-number setting circuit for setting a maximum number of externally supplied control clocks corresponding to a maximum of said duration of said first level of said charge-control clock;

a subtractor circuit for subtracting a number of externally supplied control clocks for a corresponding one of said plurality of scanning lines from said maximum number of externally supplied control clocks, and a duration-setting circuit for setting said duration of said first level of said charge-control clock for said corresponding one of said plurality of scanning lines, based upon an output from said subtractor circuit.

27. A liquid crystal display device comprising:

a liquid crystal layer;

a plurality of pixels arranged in a matrix configuration, each of said plurality of pixels being provided with a pixel electrode for generating an electric field in said liquid crystal layer between said pixel electrode and a common electrode associated with said plurality of pixels in common;

a plurality of video signal lines coupled to said plurality of pixels;

a plurality of scanning lines arranged to intersect said plurality of video signal lines and coupled to said plurality of pixels;

a driver circuit for outputting a charging voltage during a charging period at a beginning of a horizontal scanning period and then a gray scale voltage corresponding to a display data to said plurality of video signal lines during a remaining portion of said horizontal scanning period; and a display control device for outputting a charge-control clock, wherein said display control device is provided with a pulse-duration-varying circuit for varying a duration of a first level of said charge-control clock, and said driver circuit includes a charging-time control circuit for varying a charging period of said charging voltage based upon said duration of said first level of said charge-control clock such that said charging period of said charging voltage varies with a distance from said driver circuit to a scanned one of said plurality of scanning lines.

28. A liquid crystal display device according to claim 27, wherein said duration of said first level increases with increasing distance from said driver circuit to said scanned one of said plurality of scanning lines.

29. A liquid crystal display device according to claim 27, wherein said display control device outputs an ac driving signal for controlling ac-driving of said liquid crystal layer to said driving circuit, and said driver circuit includes a polarity-inverting circuit for inverting a polarity of said gray scale voltage with respect to a common voltage on said common electrode adjacent N lines of said plurality of scanning lines based upon said ac-driving signal, where N≧2.

30. A liquid crystal display device according to claim 29, wherein said N is two.

31. A liquid crystal display device according to claim 27, wherein said pulse-duration-varying circuit includes:

a maximum-clock-number setting circuit for setting a maximum number of externally supplied control clocks corresponding to a maximum of said duration of said first level of said charge-control clock;

a subtractor circuit for subtracting a number of externally supplied control clocks for a corresponding one of said plurality of scanning lines from said maximum number of externally supplied control clocks, and a duration-setting circuit for setting said duration of said first level of said charge-control clock for said corresponding one of said plurality of scanning lines, based upon an output from said subtractor circuit.

* * * * *